US005446932A

United States Patent [19]

Voorhis

[11] Patent Number: 5,446,932

[45] Date of Patent: Sep. 5, 1995

[54] FOLDING WALL BED

[76] Inventor: Donald P. Voorhis, 2412 Wembly, Troy, Mich. 48084

[21] Appl. No.: 245,697

[22] Filed: May 18, 1994

[51] Int. Cl.[6] ..... A47C 17/40

[52] U.S. Cl. ..... 5/137; 5/139; 5/159.1; 5/164.1; 5/162

[58] Field of Search ..... 5/137, 139, 140, 159.1, 5/160, 164.1, 167, 168, 143, 162

[56] References Cited

U.S. PATENT DOCUMENTS

| | | | |
|---|---|---|---|
| 298,112 | 5/1884 | Nash | 5/159 |
| 602,213 | 11/1900 | Wilmot | 5/159.1 |
| 612,592 | 10/1898 | Mellon | 5/168 |
| 963,789 | 7/1910 | Merrill | 5/164.1 |
| 1,001,214 | 8/1911 | Mulvaney | 5/160 |
| 1,164,594 | 12/1915 | Caler | 5/140 |
| 1,542,766 | 6/1925 | Hall | 5/160 X |
| 1,876,327 | 9/1932 | Lauterstein | 5/140 |
| 2,671,230 | 3/1954 | Potter | 5/160 X |
| 3,046,572 | 7/1962 | Eames et al. | 5/164.1 X |
| 3,116,494 | 1/1964 | Bennett et al. . | |
| 3,179,956 | 4/1965 | Bennett . | |
| 3,851,344 | 12/1974 | Zeithammer | 5/164.1 |
| 3,999,245 | 12/1976 | Bue et al. . | |
| 4,103,373 | 8/1978 | Luedtke et al. . | |
| 5,130,737 | 8/1992 | Reppas et al. | 5/164.1 X |

*Primary Examiner*—Michael F. Trettel
*Attorney, Agent, or Firm*—Harness, Dickey & Pierce

[57] ABSTRACT

A folding wall bed provides a frame which is pivotable from a substantially vertical stowed position to a substantially horizontal functional position. A headboard structure rises when the frame is folded to its functional position. The folding wall bed further employs a pivotably supporting first set of legs. Moreover, the folding wall bed is self concealing when in its stowed position.

29 Claims, 17 Drawing Sheets

FOLDING WALL BED

BACKGROUND OF THE INVENTION

This invention relates generally to a folding bed and specifically to a folding wall bed which is pivotable from a substantially vertical stowed position to a substantially horizontal functional position.

Folding wall beds for use in private residences, hotel rooms and mobile homes, commonly have a mattress and/or box spring supported by a frame which is pivotable from a vertical stowed position to a horizontal functional position. Most of these beds also have a stationary frame which often supports a headboard and a counterbalance mechanism. Such counterbalance mechanisms often consist of a plurality of tension springs or a cam, cable and compression spring device which aid in pivoting the mattress supporting frame. Alternatively, a few folding beds have used a counterweight panel for aiding pivoting movement. Such bed structures are discussed in the following U.S. patents: U.S. Pat. No. 4,103,373 entitled "Portable Folding Bed Cabinet," which issued to Luedtke et al. on Aug. 1, 1978; U.S. Pat. No. 3,999,245 entitled "Counterbalance Hinge for Pivoting Loads," which issued to Bue et al. on Dec. 28, 1976; and, U.S. Pat. No. 3,116,494 entitled "Wall Bed Structure," which issued to Bennett et al. on Jan. 7, 1964, all of which are incorporated by reference herewithin. Furthermore, various locking devices have been used to maintain the mattress supporting frame in its horizontal functional position. Such a locking device is discussed in U.S. Pat. No. 3,179,956 entitled "Wall Bed Structure," which issued to Bennett on Apr. 27, 1965, and is incorporated by reference herewithin.

By the nature of their pivotable design, many conventional folding wall beds require an excessive amount of floor space in both the vertical and horizontal positions. This unusable floor space is often detrimental since folding wall beds are typically used where floor space is at a premium. Some designs provide a pivoting location at the leading edge of the vertically stored bed close to the floor surface which, due to swing clearances required for the mattress and/or box springs and headboard, result in the entire bed being located some 18" to 24" from the adjacent wall when the bed is folded down to the functional position. This design does, however, allow the bed to be in close proximity to the adjacent wall when the bed is folded upright to the vertical stored position. Other designs that place the pivot point higher from the floor surface are a compromise at best. Because of the same required swing clearances, these designs result in a bed that is spaced some distance from the adjacent wall in both the vertical and horizontal positions.

Traditionally, many folding wall beds pivotably mount the mattress supporting frame partially within a specially designed cabinet enclosure or a wall recess. The cabinet enclosure is constructed so as to hide the mattress and underlying frame when pivoted to the stowed position. Furthermore, these cabinet enclosures often aesthetically cover the bed's hinging and counterbalance mechanisms. To effect this, some cabinets are equipped with folding doors and other designs incorporate a decorative panel fixed to the bottom of the bed structure. However, these cabinet enclosures can be very expensive to manufacture and commonly require additional floor space beyond the mattress supporting frame. Moreover, a person sleeping upon such a bed often has his head resting partially within the cabinet enclosure or wall recess thereby causing a claustrophobic perception. Some conventional wall beds use force generating tension springs for counterbalance that are installed in a manner to provide a pre-tension. This can require an undesirably high initial effort on the part of the user to start moving the bed from the vertical to the horizontal position.

Additionally, many conventional folding wall beds are bolted to the adjacent floor or walls. This can damage the underlying carpet, hardwood or tile floors. Therefore, an improved folding wall bed is desired that allows choice in mounting—either wall mount, floor mount or completely freestanding—without need of a separate cabinet and uses a minimum of floor space in both the vertical stored position and in the horizontal functional position, and is easier to fold down.

SUMMARY OF THE INVENTION

In accordance with the preferred embodiments of the present invention, a new and useful folding wall bed provides a frame which is pivotable from a substantially vertical stowed position to a substantially horizontal functional position. The frame is substantially L-shaped in configuration having a supporting segment with a first edge and a second edge. The frame also has an extension segment which projects substantially perpendicular from the first edge of the supporting segment. In a first preferred embodiment, the supporting segment of the frame upholds a mattress and in a second preferred embodiment of the present invention, the supporting segment of the frame upholds a box spring and a mattress. The folding wall bed provides a wall structure which has a substantially vertical component with at least one engagement mechanism therein. A headboard structure is slidably associated with the engagement mechanism such that the headboard structure is slidable along a vertical plane defined by the wall structure. The headboard structure is pivotably linked with the extension segment of the frame such that the headboard structure is slidably located in a raised position when the supporting segment of the frame is pivoted to the substantially horizontal functional position. Furthermore, the headboard structure is slidably located in a retracted and relatively lower position when the supporting segment of the frame is pivoted to the substantially vertical stowed position. The present invention also has a force generating device which aids in the slidable movement of the headboard structure in relation to the wall structure. Additionally, the first preferred embodiment of the present invention folding wall bed has a first set of legs which are pivotably attached to the frame near the first edge of the supporting segment. Also, a second set of legs are pivotably attached to the frame near the second edge of the supporting segment. Moreover, in another aspect of the present invention, the folding wall bed is provided with aesthetically pleasing covering panels on exposed portions thereof.

The folding wall bed of the present invention has many advantages over conventional designs. For example, this novel bed efficiently uses a minimum of valuable floor space. This is accomplished by the many pivotable joints, the vertically oriented wall structure, the use of a sliding headboard structure and a force generating device such as a spring or a motor and screw combination. Accordingly, the mattress and/or box spring supporting segment of the frame can be juxtaposed significantly closer to an adjacent room wall as compared to prior traditional constructions. Furthermore, the folding wall bed of the present invention does not require an associated cabinet or wall recess. Not only does this make the present invention less expensive and more aesthetically versatile, but it also avoids the traditional claustrophobic perception of the bed occupant when his head is positioned within the conventional cabinet enclosure. Also, the present invention allows attachments to either the floor or wall of the room or it can be totally freestanding. Moreover, the folding wall bed is easily hidden when stowed by an inexpensive aesthetic covering configuration. By selectively adding or deleting foldable side panels, the bed can be used as a stand-alone unit or in combination with storage cabinets or bookcases placed on one or both sides of the bed.

Additional advantages and features of the present invention will become apparent from the following description and appended claims, taken in conjunction with the accompanying drawings.

DETAILED DESCRIPTION OF THE PREFERRED EMBODIMENTS

Figure 2:
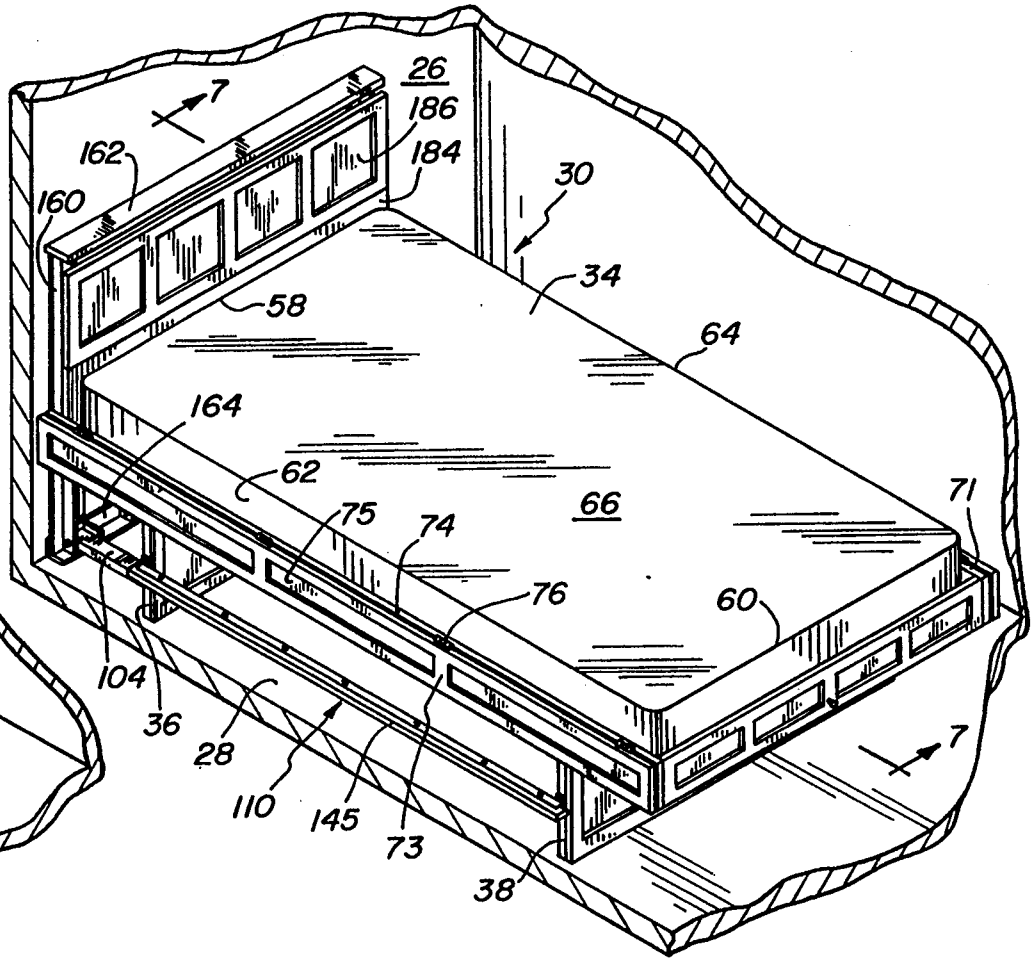
FIG. 2 is a perspective view of the present invention folding wall bed of FIG. 1 shown in a substantially horizontal functional position.
Figure 1:
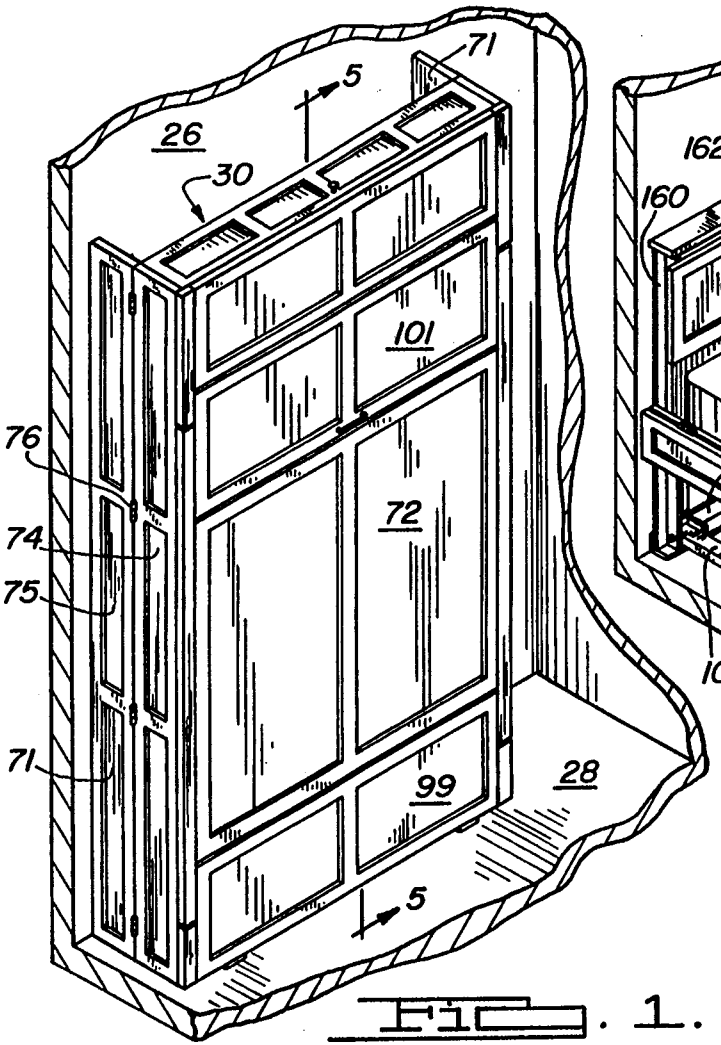
FIG. 1 is a perspective view of a first preferred embodiment of a folding wall bed of the present invention shown in a substantially vertical stowed position.

Generally, a folding wall bed is pivotable from a substantially vertical stowed position adjacent to a room wall 26, as is shown in FIG. 1, to a substantially horizontal functional position adjacent to a room floor 28, as is shown in FIG. 2. A first preferred embodiment of the folding wall bed 30 of the present invention is shown in FIGS. 1 through 9. Folding wall bed 30 is comprised of a frame 32, a mattress 34, a first set of legs 36, a second set of legs 38, a wall structure 40, a headboard structure 42, a force generating device 44 and a plurality of aesthetically pleasing cover panels.

Frame 32 has a substantially L-shaped configuration with a mattress supporting segment 46 and an extension segment 48. Mattress supporting segment 46 is constructed from a pair of longitudinal rails 50 joined transversely by a plurality of cross rails 52. Furthermore, mattress supporting segment 46 has a first edge 54 proximate to wall structure 40 and a second edge 56 which is displaced at the opposite end thereof. In this embodiment, first edge 54 is coincidental with a head 58 of mattress 34 and second edge 56 is coincidentally adjacent to a foot 60 of mattress 34. Head 58 and foot 60 of mattress 34 are also joined by a pair of sides 62 and 64 as well as a top surface 66 and a bottom surface (not shown). Bottom surface of mattress 34 is supported by a first planar surface defined by a ¼" plywood sheet (not shown) mounted upon an upper side 68 of longitudinal rails 50 and cross rails 52 (as shown pivoted to the substantially horizontal functional position). Oppositely, a second planar surface is defined by a hidden side 70 of longitudinal rails 50 and cross rails 52. Moreover, a wooden aesthetic covering panel 72 is fastened to cross rails 52 along the second planar surface thereof.

Figure 8:
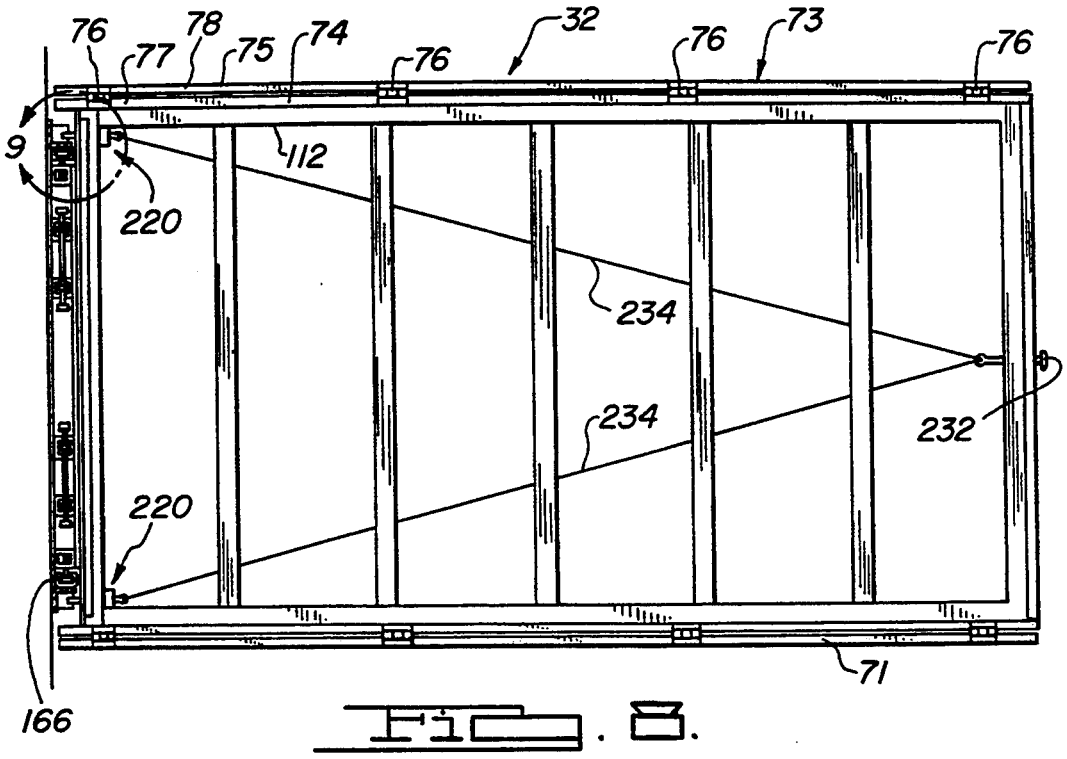
FIG. 8 is a top elevational view of the present invention folding wall bed of FIG. 4, shown in the substantially horizontal functional position with the mattress removed.

Referring to FIGS. 1, 2 and 8, the operation of side covering panels 71 is shown. Each set of side covering panels 73 is defined by a first wooden board 74 and a second wooden board 75 which are pivotably connected to one another by a plurality of hinges 76 along adjacent longitudinal edges 77 and 78 thereof. First wooden boards 74 are attached to longitudinal rails 50. Accordingly, when mattress supporting segment 46 is pivoted to the substantially vertical stowed position, as shown in FIG. 1, second board 75 is swung to an open position in planar alignment with first board 74 thereby substantially hiding wall structure 40. Alternately, when mattress supporting segment 46 is pivoted to the substantially horizontal functional position, as is shown in FIGS. 2 and 8, second board 75 is swung to an overlapping position thereby allowing easy access to mattress 34. If the wall bed is installed next to a vertical storage cabinet or bookcase, neither panel 75 nor hinges 76 would be used as the cabinet or bookcase would serve to conceal the wall structure 40. This could apply to one or both sides of the wall bed.

As can best be seen in FIGS. 2–4 and 8, first set of legs 36 is constructed from a pair of substantially vertical beams 80 and 82 which are joined by an upper horizontal beam 84 and a lower horizontal beam 86. Upper distal ends 88 and 90 of vertical beams 80 and 82, respectively, are affixed to shoes 92 and 94, respectively, which are in turn, pivotably attached to longitudinal rails 50 at pivot points 98. Second set of legs 38 is similarly constructed. Notwithstanding, each vertical beam 80 and 82 of first set of legs 36 has a lower distal end 100 and 102, respectively, which are pivotably connected to a pair of braces 104 and 106, respectively. Braces 104 and 106 are juxtaposed adjacent to floor 28 of the room and each brace 104 and 106, near first set of legs 36, have an adjustable leveling screw 108 attached therebelow. At the opposite end, each brace 104 and 106 is pivotably linked to lower beam 164 of wall structure 40. Additionally, aesthetic covering panels 99 and 101 are mounted to first and second sets of legs, respectively 36 and 38.

Additionally, legs 36 and 38 are automatically extendable and retractable through use of a linkage mechanism 110. Linkage mechanism 110 is comprised of a pair of unitary members 140 and 142 which are symmetrically attached to vertical beams 80 and 144 or 82 and 128, through pivotable brackets 146. These unitary members 140 and 142 may be decoratively hidden by wooden aesthetic cover panels 145. Linkage mechanism 110 provides for synchronous and similarly directed pivotal movement of first and second set of legs, respectively 36 and 38, from the substantially vertical stowed position shown in FIG. 3, to the functionally extended position, shown in FIG. 4.

Figure 11:
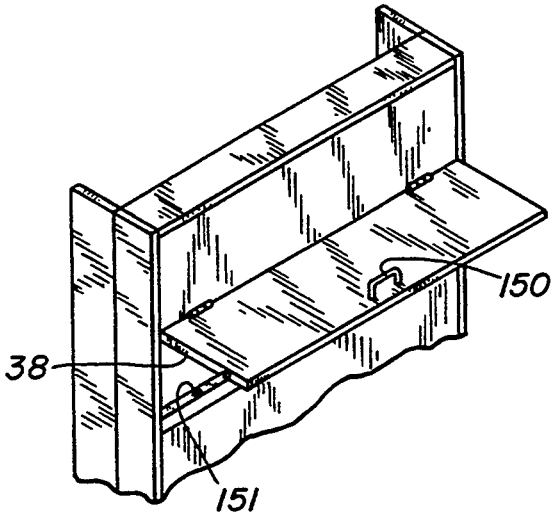
FIG. 11 is a fragmentary perspective view, similar to that of FIG. 10, of a second alternate embodiment of the folding wall bed of the present invention of FIG. 1 showing a manually actuatable set of legs.

FIG. 11 depicts a second alternate embodiment wherein second set of legs 38 is manually extended by use of an external handle 150 and a pair of pivoting linked arms 151. Linked arms 151 can be locked into an extended position by aligning linked arms 151 with one another.

Returning to the first preferred embodiment shown in FIGS. 1 through 9, wall structure 40 is oriented in a substantially vertical direction and is defined by a pair of vertical beams 160, a substantially horizontal upper beam 162 and a substantially horizontal lower beam 164 which is proximate with floor 28. A pair of engagement mechanisms or channels 166 are mounted on an interior surface of each vertical beam 160. Furthermore, braces 104 and 106 are pivotably attached to horizontal lower beam 164. Wall structure 40 must be attached to a wall 167 or to floor 28.

Figure 9:
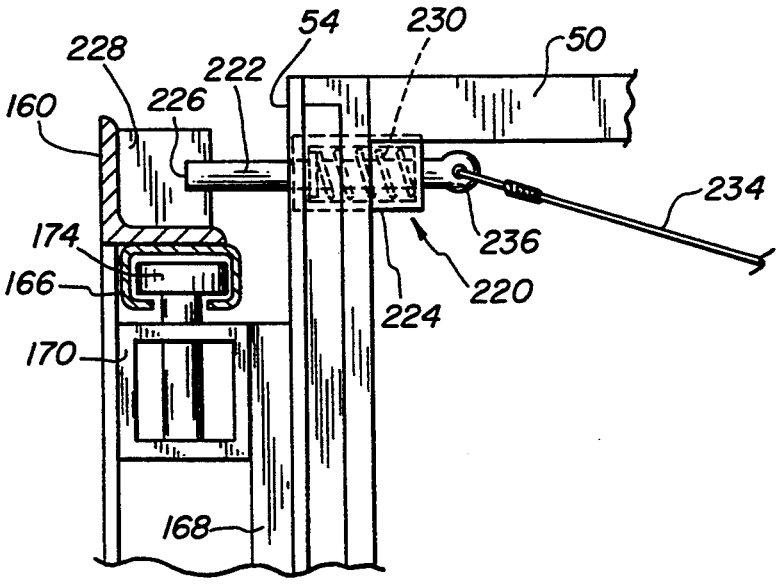
FIG. 9 is an enlarged top elevational view, taken within circle 9 of FIG. 8, of the present invention folding wall bed.
Figure 10:
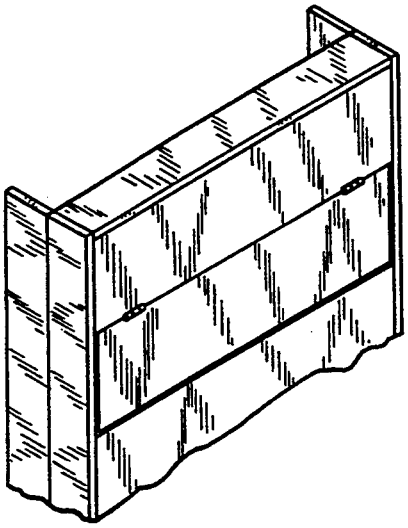
FIG. 10 is a fragmentary perspective view of a first alternate embodiment of the present invention folding wall bed of FIG. 1, shown in the substantially vertical stowed position with the aesthetic covering panels in place.

Additionally, headboard structure 42 is constructed from a pair of substantially horizontal cross members 168 which are joined by a pair of substantially vertical outboard members 170 and a plurality of substantially vertical hollow sleeve members 172. As is best illustrated in FIG. 9, channel 166 has a C-shaped cross sectional shape for engagement with a plurality of engagement mechanisms or 1" diameter rollers 174 which rotatably project from outboard members 170. Referring to FIGS. 2 through 8, a pair of clevises 180 are integrally attached to the lower of cross members 168. These clevises 180 pivotably engage a pair of arms 182, each having an extension mount and a tab 185 extending therefrom, which define extension segment 48 of frame 32. Arms 182 are integrally mounted to mattress supporting segment 46 and extend perpendicularly therefrom. The majority of rails and members are made from square or rectangular cross sectionally shaped welded steel tubing or steel angles. Furthermore, a bumper (not shown) may be installed on lower horizontal beam 164 of wall structure 40 or alternatively on the bottom of headboard cross member 168 to dampen the downward movement of headboard structure 42. Moreover, a wooden covering panel 184 is attached to arms 182. Similarly, a wooden headboard panel 186 decoratively covers headboard structure 42.

Figure 3:
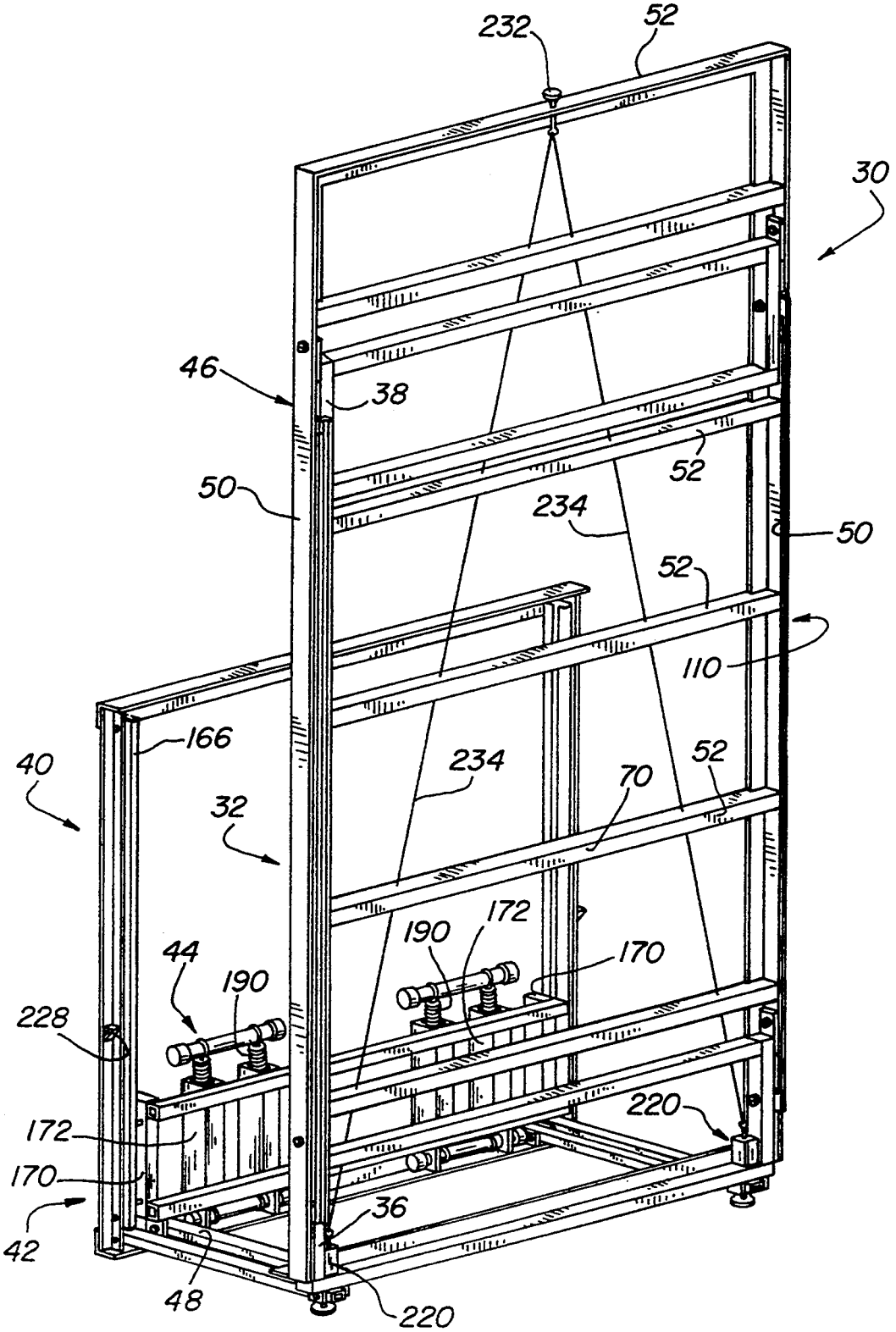
FIG. 3 is a perspective view of the present invention folding wall bed of FIG. 1, with the aesthetic cover panels and mattress removed, shown in a substantially vertical stowed position.

Force generating device 44 is comprised of a plurality of helically wound tension springs 190. Each spring 190 has a first looped end 192 which engagably wraps around the circumference of a first cylindrical bar 194. Also, the coils of each spring 190 are interposed within the congruent of hollow sleeve members 172 such that a second looped end of each spring 190 is engagably wrapped around a second cylindrical bar 198. Second cylindrical bar 198 is connected to a pair of brackets 200 which are secured to horizontal lower beam 164. Therefore, springs 190 aid in pivoting frame 32 into the substantially vertical stowed position by urging headboard structure 42 into a lower retracted position, as is shown in FIG. 3. As shown in FIG. 3, the top end 192 of springs 190 can be such that they extend beyond the top edge of hollow members 172. This allows the initial downward motion of the bed structure from the vertical position to be unincumbered by spring resistance to ease in the lowering of the bed. A queen size bed employs six springs 190, a full size bed employs four springs 190 and a twin size bed employs two springs 190. Thus, twenty pounds of force applied to the foot of the bed is preferably needed to lift mattress supporting segment 46 from its functional position to its stowed position.

Referring to FIGS. 3, 4, 8 and 9, a locking mechanism 220 is operable to secure mattress supporting segment 46 of frame 32 in the substantially horizontal functional position. Locking mechanism 220 is comprised of a wedge-shaped bar 222 which is slidably housed within a casing 224. Casing 224 is attached to frame 32 such that wedge-shaped bar 222 is oriented substantially parallel to longitudinal rails 50. Furthermore, wedge-shaped bar 222 has a tapered end 226 which is indexed to interface with an interlocking receptacle or a beveled formation 228. Wedge-shaped bar 222 is forced to longitudinally retract into casing 224 by engagement with beveled formation 228 as mattress supporting segment 46 is pivoted from the stowed position to the functional position. Upon clearing beveled formation 228 wedge-shaped bar 222 is allowed to fully project outward from casing 224. This extension of wedge-shaped bar 222 is caused by a compression spring 230 contained within casing 224. Accordingly, frame 32 is then interlocked into the substantially horizontal functional position. The wedge-shaped bar can be retracted by a person pulling on an interlocking retraction device or handle 232 located along second edge 56 of mattress supporting segment 46. Handle 232 is operably connected to a pair of cables 234 which further engage an eyelet 236 formed within an end of each wedge-shaped bar 222. Thus, when handle 232 is pulled, cables 234 retract wedge-shaped bar 222 so that frame 32 can be returned to its stowed position. Of course, the interlocking receptacle could take the form of an orifice (not shown) formed within vertical beams 160 of wall structure 40. Also, the interlocking-retraction device could alternately take the form of a lever (not shown) directly coupled to wedge-shaped bar 222.

Figure 5:
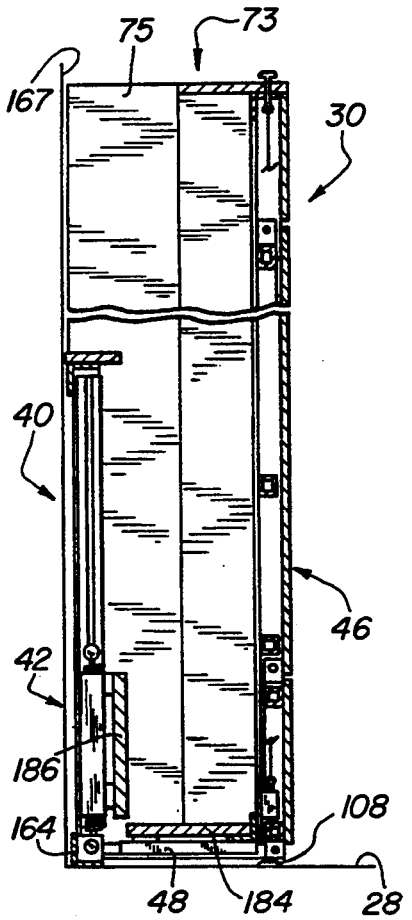
FIG. 5 is a sectional view, taken along line 5—5 of FIG. 1, of the present invention folding wall bed.
Figure 6:
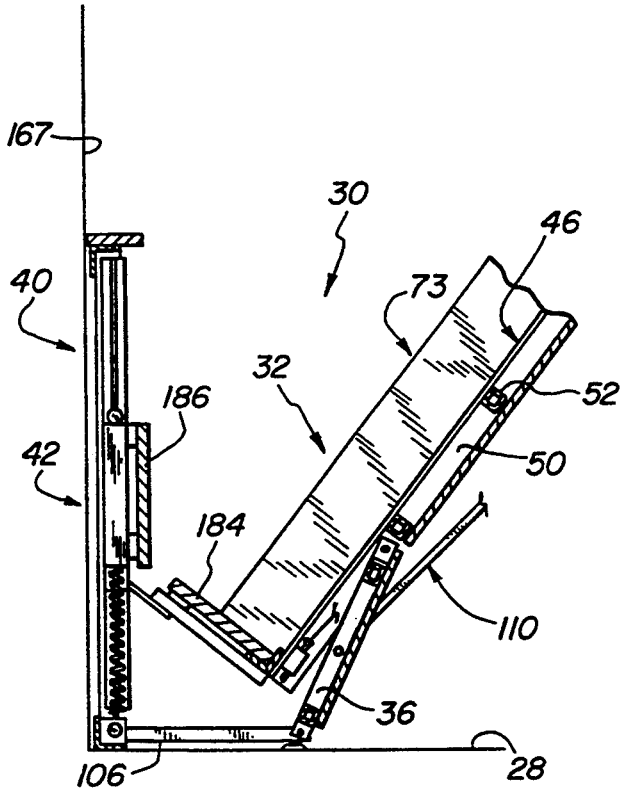
FIG. 6 is a sectional view, similar to that of FIG. 5, of the present invention folding wall bed shown in a pivoted position approximately half way between the substantially vertical stowed position and the substantially horizontal functional position.
Figure 7:
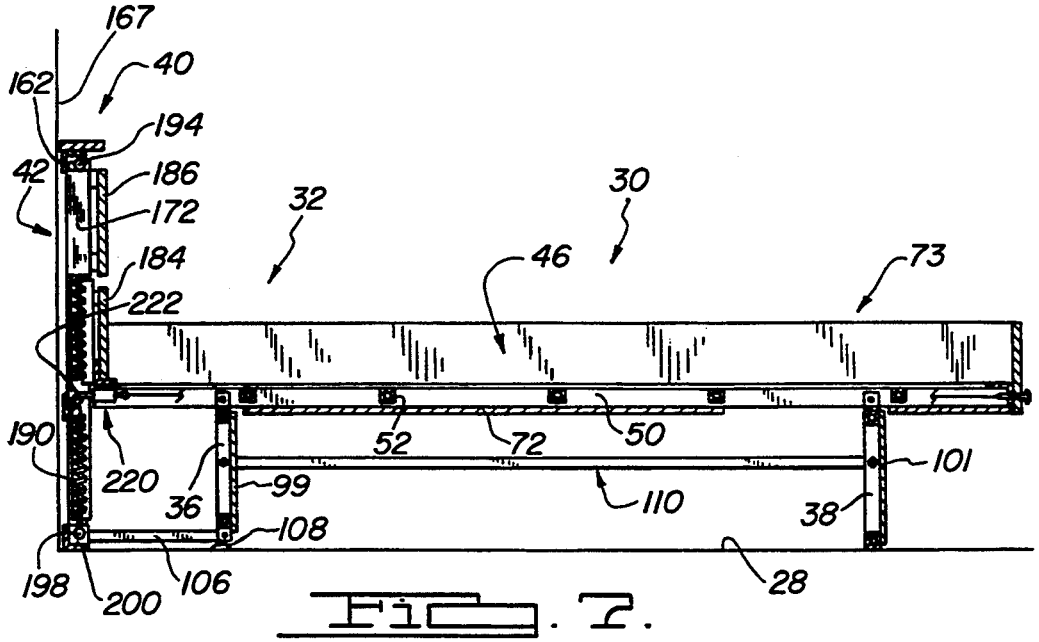
FIG. 7 is a sectional view, taken along line 7—7 of FIG. 2, of the present invention folding wall bed.

The pivoting operation of folding wall bed 30 is best depicted in FIGS. 5 through 7. In FIG. 5, mattress supporting segment 46 is oriented in the substantially vertical stowed position with extension segment 48 substantially parallel with floor 28. Concurrently, headboard structure 42 is in a relatively low retracted position proximate with lower horizontal beam 164. In FIG. 6, mattress supporting segment 46 of frame 32 is oriented approximately halfway between the stowed position and the functional position. Simultaneously, headboard structure 42 has slid approximately halfway up the vertical length of wall structure 40. Also, first set of legs 36 has an angled orientation relative to longitudinal rails 50 and brace 106. Finally, FIG. 7 illustrates mattress supporting segment 46 in the substantially horizontal functional position with headboard structure 42 proximate with upper horizontal beam 162. In this position, first and second sets of legs, respectively 36 and 38, extend substantially perpendicular from mattress supporting segment 46.

Figure 13:
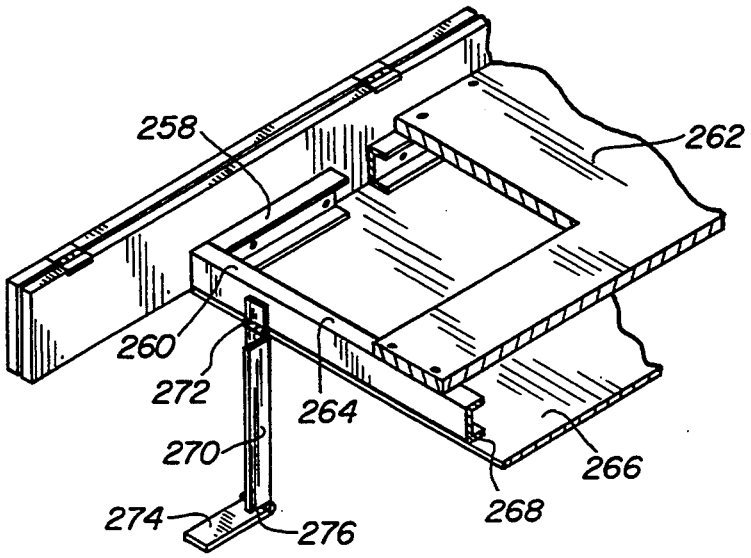
FIG. 13 is a fragmentary perspective view of the third alternate embodiment of the present invention folding wall bed of FIG. 12 with portions broken away therefrom.
Figure 12:
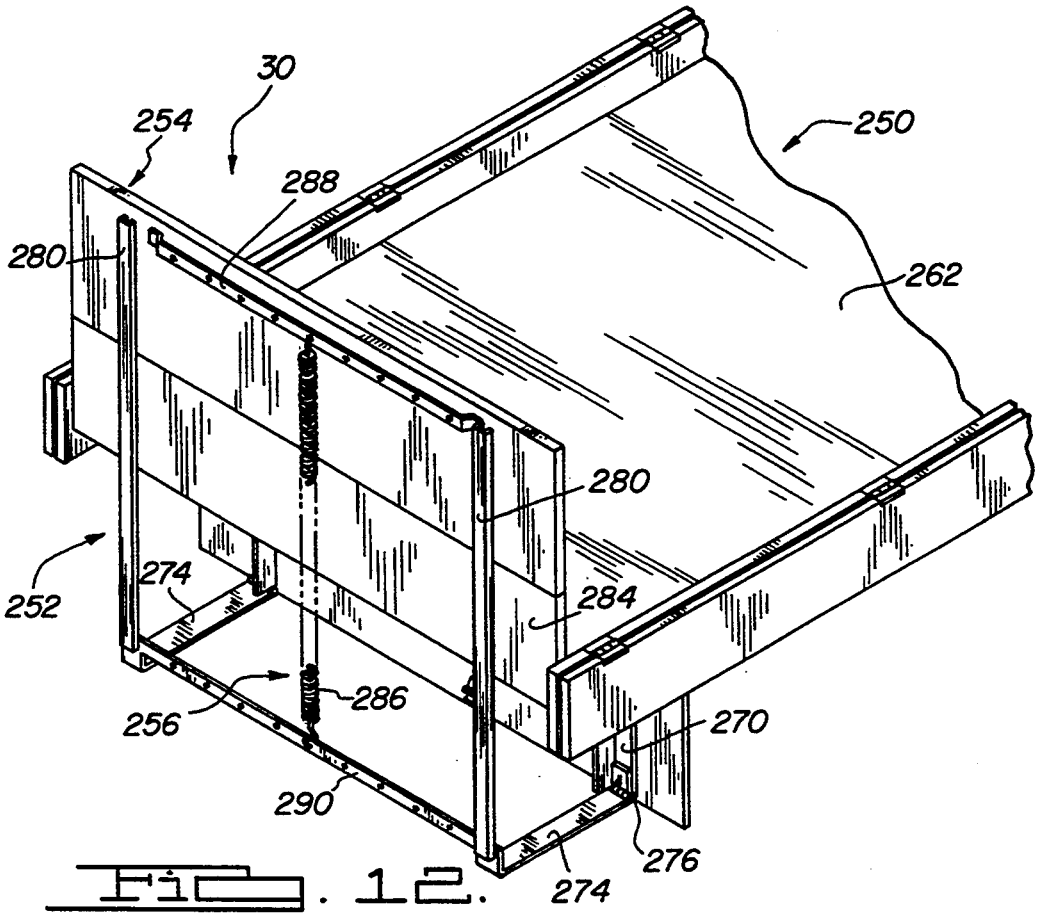
FIG. 12 is a fragmentary perspective view of a third alternate embodiment of the folding wall bed of the present invention of FIG. 1, shown in the substantially horizontal functional position with the mattress removed.

A third alternate embodiment of the present invention folding wall bed is shown in FIGS. 12 and 13. This embodiment provides for a simplified frame 250, wall structure 252, headboard structure 254 and force generating device 256. Frame 250 is comprised of a pair of longitudinal rails 258 joined by at least a pair of cross rails 260. Furthermore, a structural board 262 is attached onto a first planar surface 264 of longitudinal and cross rails 258 and 260, respectively. Also, an aesthetically pleasing wooden board 266 or other covering material is affixed to a second planar surface 268 of longitudinal and cross rails, respectively 258 and 260. The mattress 34 (see FIG. 2) is placed on top of structural board 262. A first set of legs 270 and a second set of legs (not shown) are pivotably affixed to cross rails 260 by a hinge 272. Moreover, first set of legs 270 is pivotably attached to a pair of braces 274 by a similar set of hinges 276.

The wall structure 252 of this third alternate embodiment is comprised of a pair of C-shaped channels 280 upon which a headboard structure 254 is slidably engaged. Headboard structure 254 is simply a wooden panel with rollers (see, for example, 174 of FIG. 9) affixed to the back side thereof. Frame 250 is pivotably connected to headboard structure 254 through an extension board 284 which extends perpendicularly therefrom. Force generating device 256 uses a plurality of helically wound tension springs 286 one end of which is in hooked engagement with a perforated bar 288 attached to headboard structure. The other end of spring 286 is in hooked engagement with a horizontal lower beam 290 affixed to wall structure 252. The folding wall bed 30 of this embodiment operates in generally the same manner as do the prior embodiments.

Figure 14:
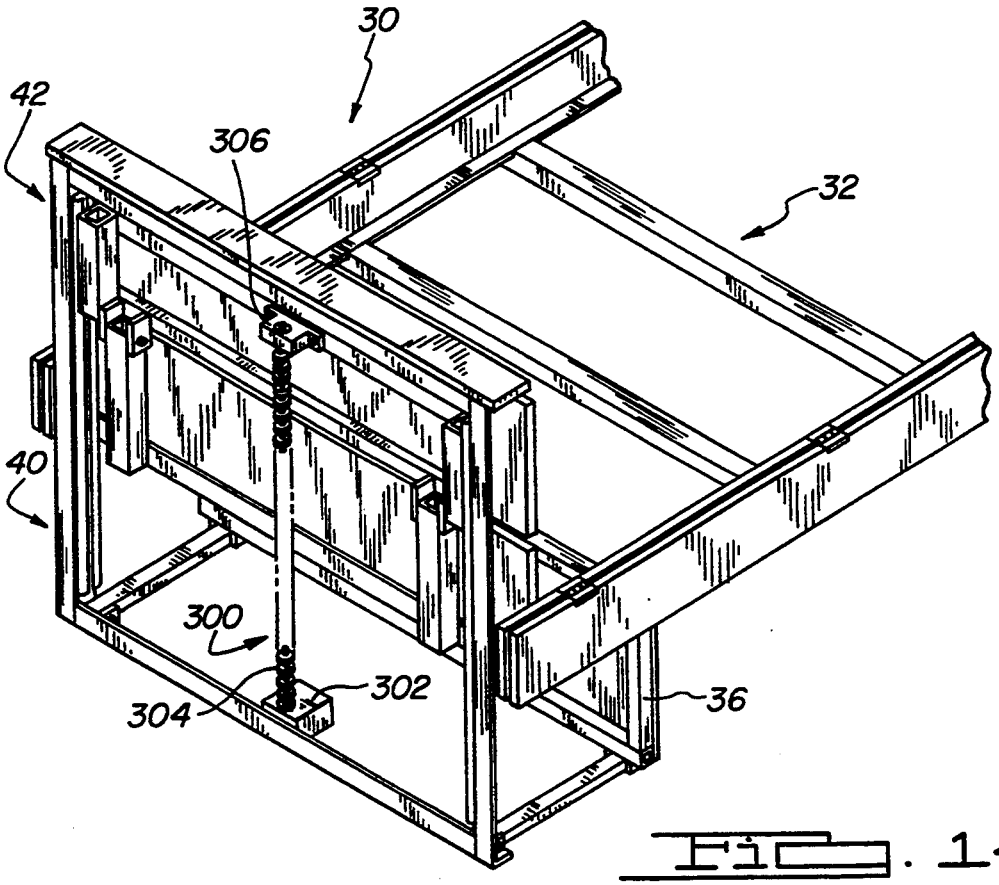
FIG. 14 is a fragmentary perspective view of a fourth alternate embodiment of the folding wall bed of the present invention of FIG. 1, shown in the substantially horizontal functional position with the mattress removed and with a motorized force generating device.

Referring to FIG. 14, a fourth alternate embodiment of the folding wall bed 30 of the present invention provides a motorized force generating device 300. Motorized force generating device 300 uses an electric motor 302 for driving a worm gear 304. In turn, worm gear 304 is in threaded engagement with a receptacle 306. Furthermore, receptacle 306 is attached to the back side of headboard structure 42 and motor 302 is secured to wall structure 40. Therefore, motorized force generating device 300 serves to pivot frame 32 between the stowed position and the functional position.

Figure 15:
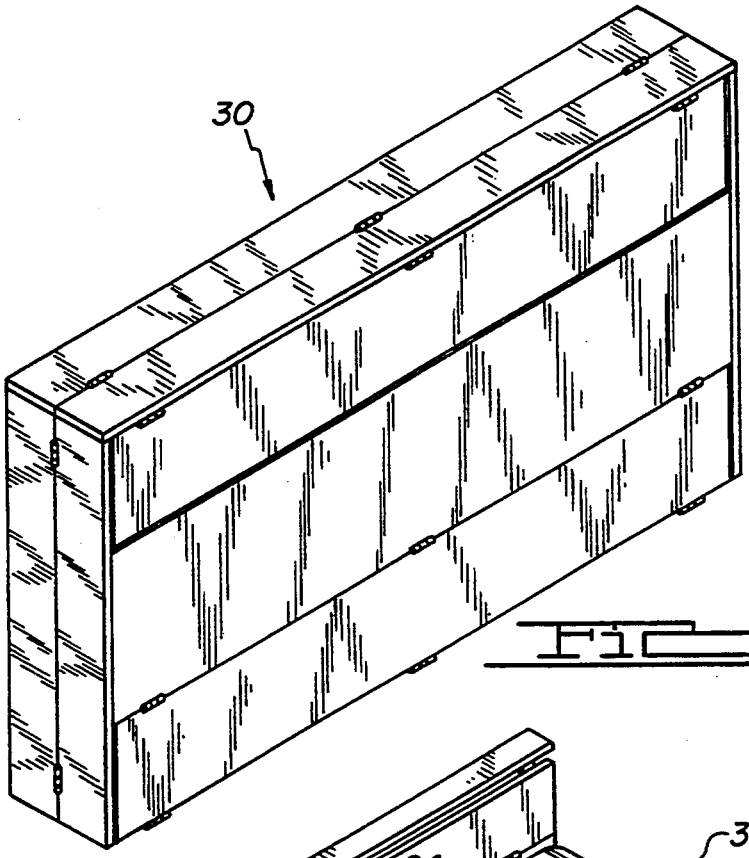
FIG. 15 is a perspective view of a fifth alternate embodiment of the folding wall bed of the present invention of FIG. 1 shown in a substantially vertical stowed position.
Figure 16:
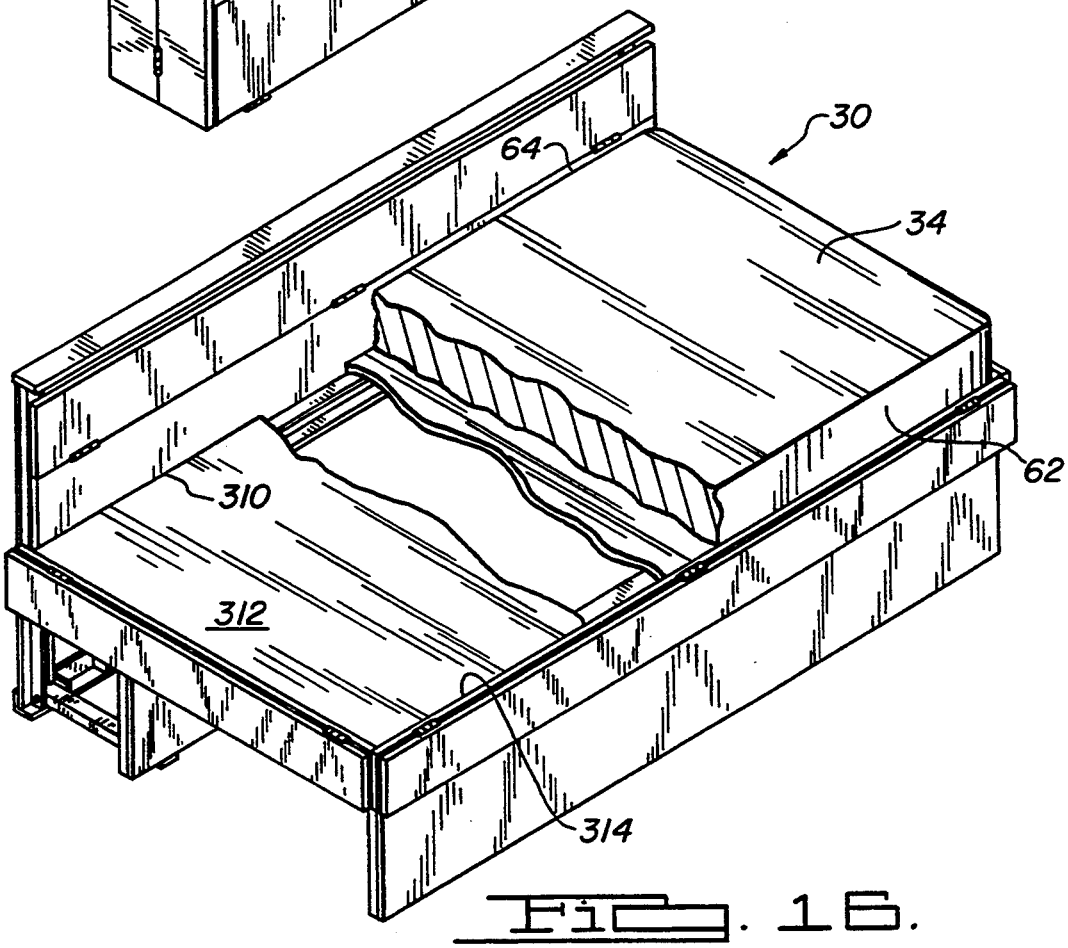
FIG. 16 is a perspective view of the fifth alternate embodiment of the present invention folding wall bed of FIG. 15 shown in a substantially horizontal functional position.
Figure 18:
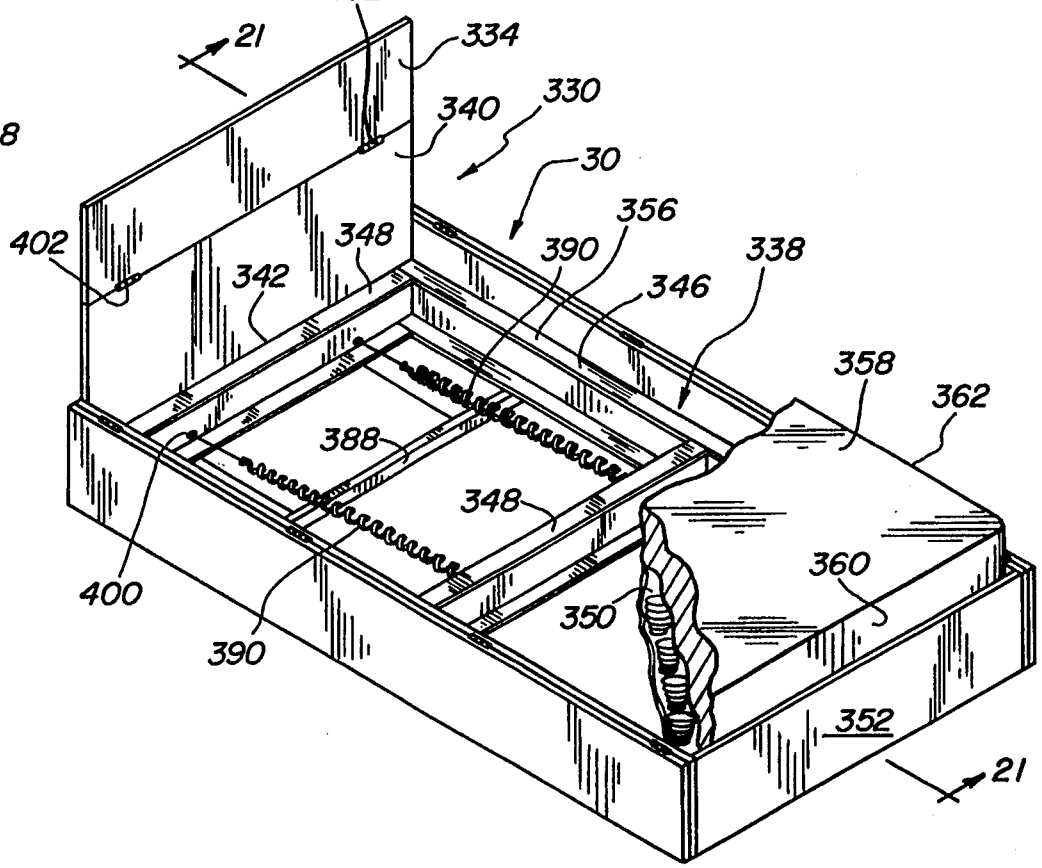
FIG. 18 is a perspective view with portions broken away therefrom, similar to that of FIG. 2, of the present invention folding wall bed of FIG. 17.
Figure 17:
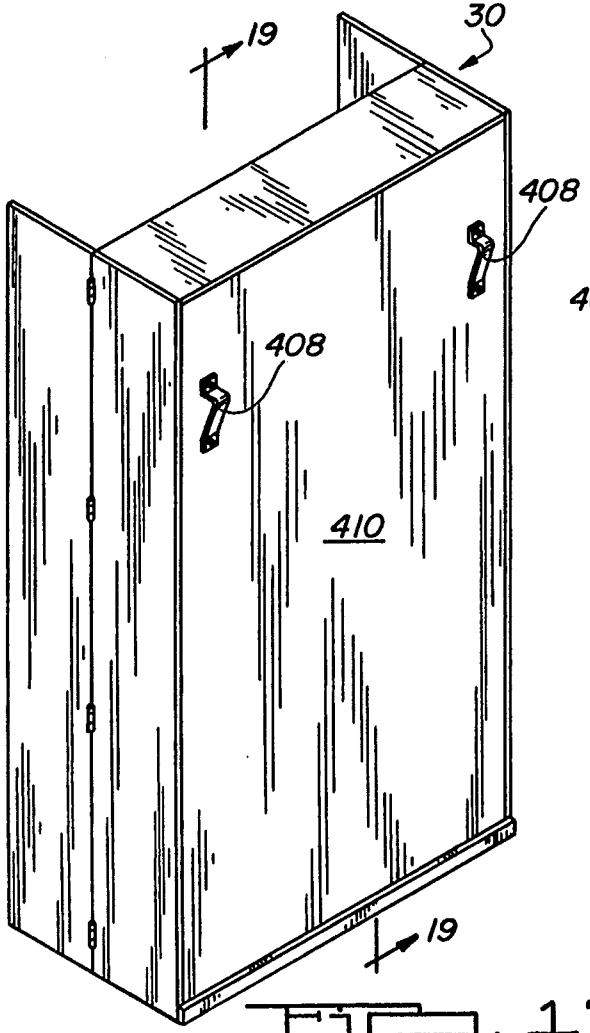
FIG. 17 is a perspective view, similar to that of FIG. 1, of a second preferred embodiment of the folding wall bed of the present invention.

A fifth alternate embodiment of the present invention folding wall bed 30 is depicted in FIGS. 15 and 16. In this embodiment, side 64 of mattress 34 is adjacent to first edge 310 of mattress supporting segment 312. Oppositely, side 62 of mattress 34 is adjacent to second edge 314 of mattress supporting segment 312. Therefore, folding wall bed 30 of this design is ideally suited for use along a wall having windows or wall mounted shelves.

A second preferred embodiment of the folding wall bed 30 of the present invention is illustrated in FIGS. 17 through 22. Bed 30 is comprised of a frame 330, a wall structure 332, a headboard structure 334 and a force generating device 336. Frame 330 has an L-shaped configuration and is defined by a supporting segment 338 and an extension segment 340 which projects substantially perpendicular from a first edge 342 thereof. Supporting segment 338 also has a second edge 344 which is displaced opposite from first edge 342. Supporting segment is further defined by a pair of longitudinal rails 346 and a plurality of cross rails 348. A box spring 350 having a head (not shown), a foot 352 and a pair of sides 354, is juxtaposed upon a first planar surface 356 defined by an upper portion of longitudinal and cross rails, respectively 346 and 348. A mattress 358 sits on top of box spring 350 and has a head (not shown), foot 360 and a pair of sides 362 coincidental with those of box spring 350. Heads (not shown) of box spring 350 and mattress 358 are proximate with first edge 342 and feet 352 and 360 are proximate with second edge 344.

Extension segment 340 of frame 330 has a pair of outboard brackets 370 and an adjacent pair of smaller inboard brackets 372. Each outboard bracket 370 and the adjacent inboard bracket 372 have a roller 374 rotatably journalled therein. Each roller 374 is juxtapositioned so as to extend below the intersection of extension segment 340 and supporting segment 338.

Wall structure 332 has a substantially vertical component and a substantially horizontal component. The substantially vertical component is comprised of a pair of C-shaped channels 380 with which headboard structure 334 is slidably engaged in a manner similar to that of the first preferred embodiment. Additional structural beams may of course be employed. The horizontal component of wall structure 332 is comprised of a pair of floor tracks 382 which are adjacent to floor 28 (see FIG. 1). Floor tracks 382 each have a leading edge 384 and a trailing edge 386. Leading edge 384 is attached to a stanchion 388 which transversely joins the two floor tracks 382 to one another. Trailing edge 386 of each floor track 382 is proximate with the vertical component of wall structure 332 and each floor track 382 gradually declines in angular attitude from trailing edge 386 to leading edge 384.

Force generating device 336 is comprised of a plurality of helically wound tension springs 390 each having a first section 392 engagably affixed to a cross rail 348. Each spring 390 has a second section 394 which is operably coupled with a cable 396. A pulley 398 is rotatably mounted to frame 330 near the intersection of extension segment 340 and supporting segment 338. Each cable 396 extends through an opening 400 in frame 330 and wraps around a portion of pulley 398 such that the direction of cable 396 is reversed. Furthermore, cables 396 are attached to stanchion 388.

Figure 4:
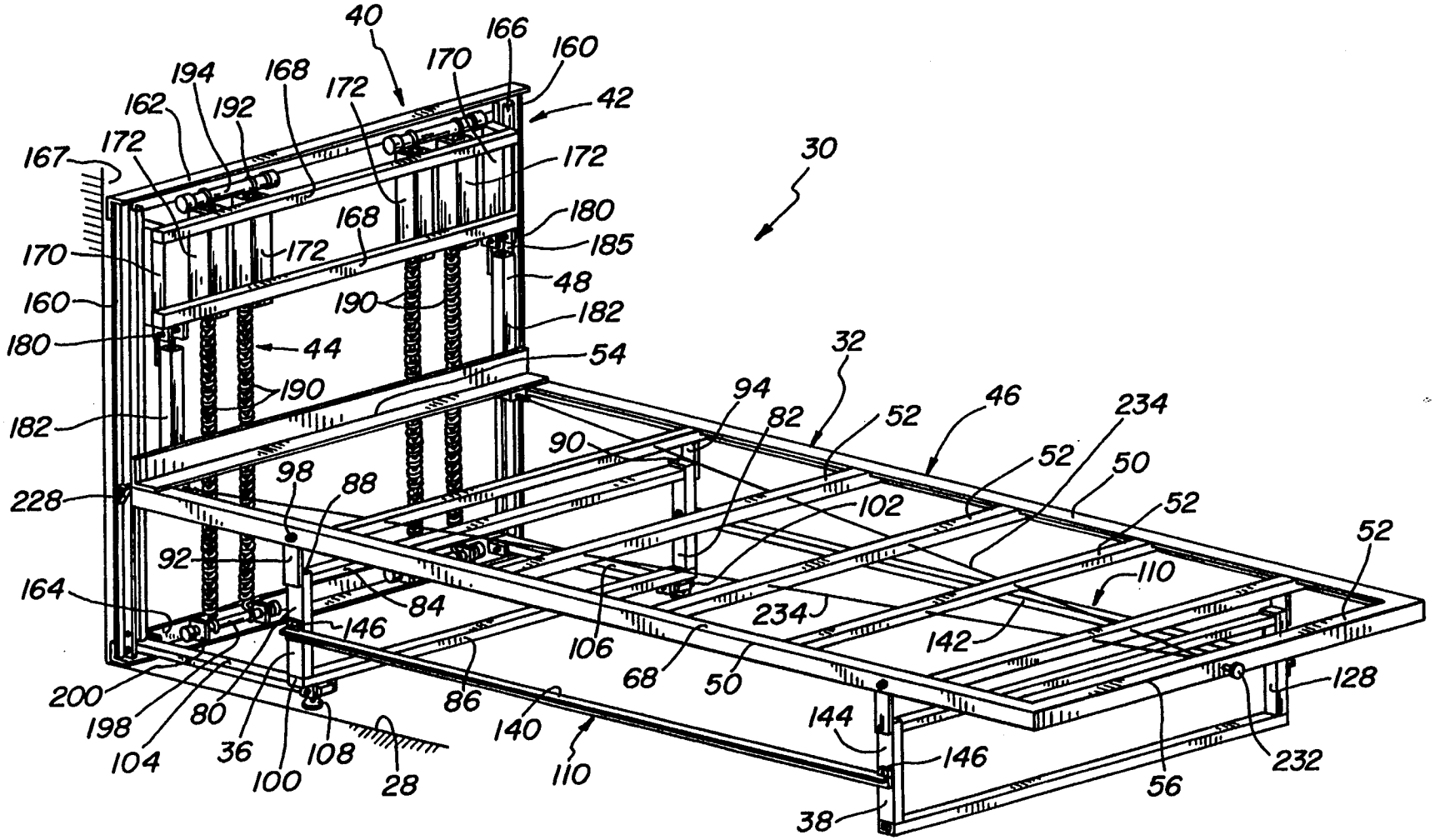
FIG. 4 is a perspective view of the present invention folding wall bed of FIG. 1, with the aesthetical cover panels and mattress removed, shown in a substantially horizontal functional position.
Figure 19:
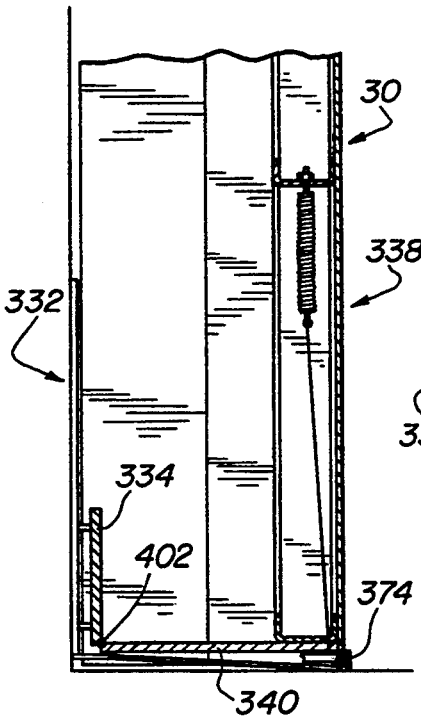
FIG. 19 is a sectional view, taken along line 19—19 of FIG. 17, of the present invention folding wall bed.
Figure 20:
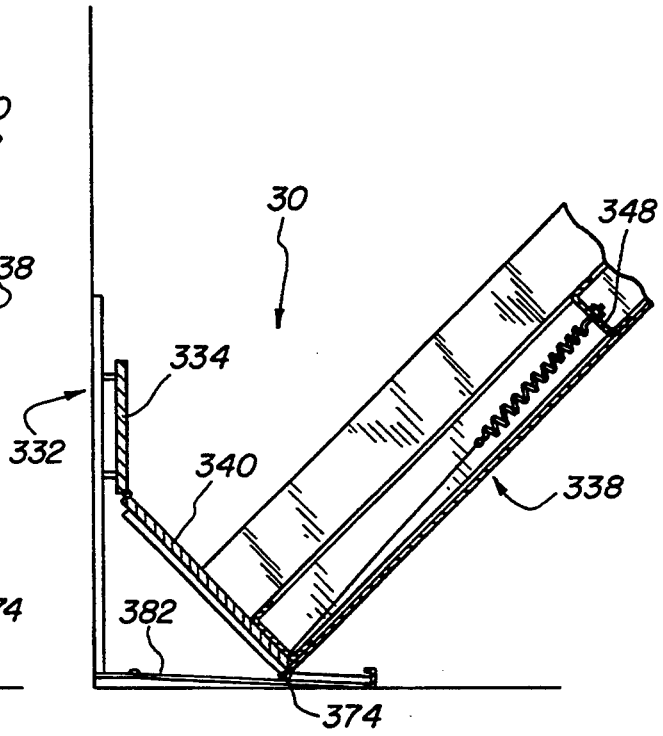
FIG. 20 is a sectional view, similar to that of FIG. 19, of the present invention folding wall bed of FIG. 17 Shown at a pivoted position approximately halfway between the substantially vertical stowed position and the substantially horizontal functional position.
Figure 21:
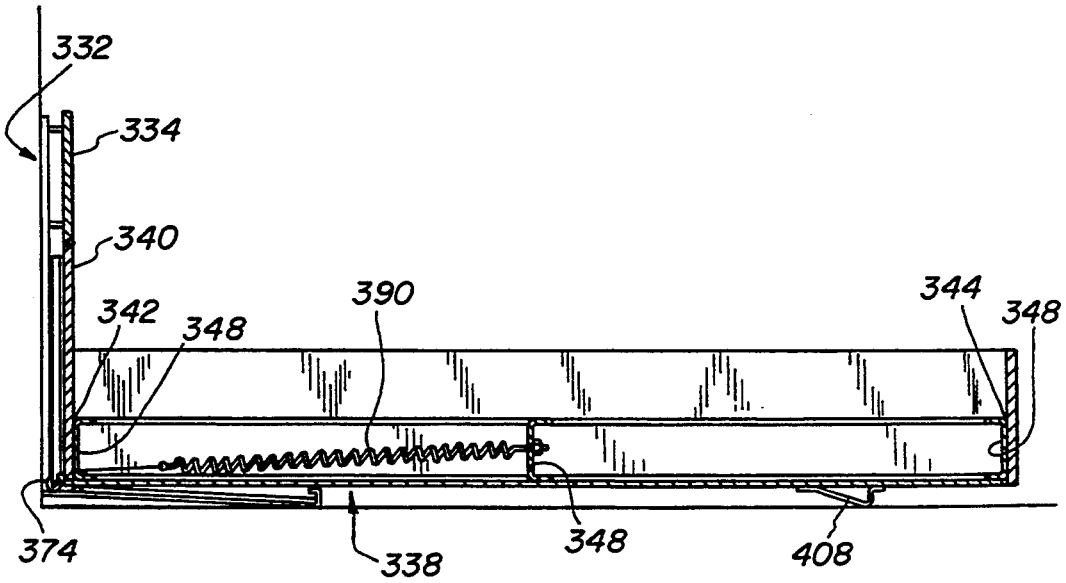
FIG. 21 is a sectional view, taken along line 21—21 of FIG. 18, of the present invention folding wall bed.
Figure 22:
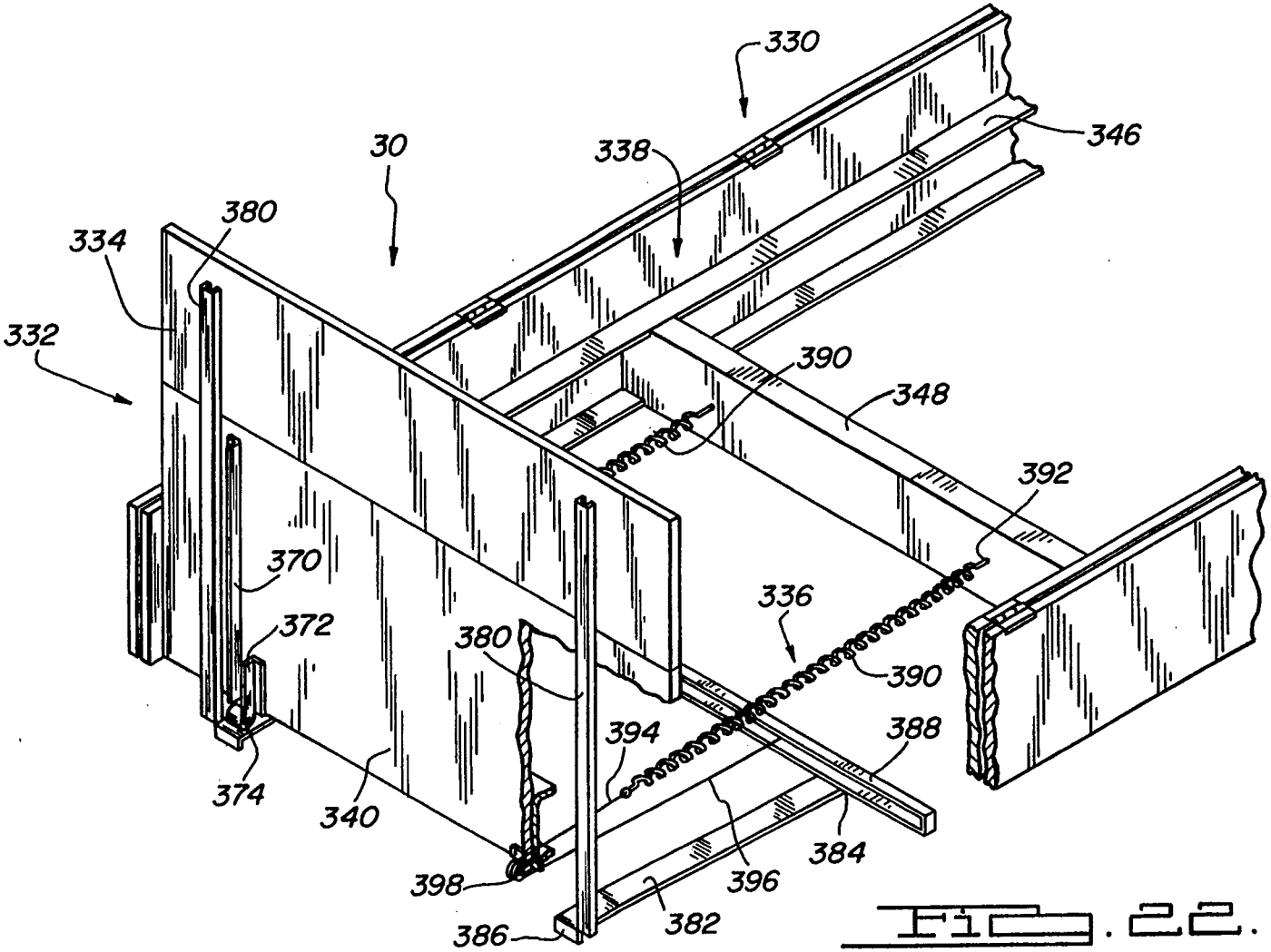
FIG. 22 is a fragmentary perspective view with portions broken away therefrom of the present invention folding wall bed of FIG. 17, shown in the substantially horizontal functional position with a mattress and box spring removed.

Headboard structure 334 is shown and described hereinafter in a simplified alternate construction, however, headboard structure 334 would preferably be constructed similar to that shown in FIGS. 3 and 4. The present exemplary headboard structure 334 is pivotably attached to extension segment 340 by a pair of hinges 402 such that when supporting segment 338 of frame 330 is in the substantially vertical stowed position, as shown in FIG. 19, headboard structure 334 is in a relatively low retracted position relative to wall structure 332. As is shown in FIG. 20, headboard structure 334 slides upward along wall structure 332 and rollers 374 move along the gently inclining floor tracks 382 when supporting segment 338 of frame 330 is pivoted from the stowed position to the functional position. Furthermore, headboard structure 334 is slid toward the top of wall structure 332 and rollers 374 move to a position substantially adjacent to wall structure 332 when supporting segment 338 is in the substantially horizontal functional position, as is shown in FIG. 21. In this functional position spring 390 is stretched so as to aid in upward pivoting of supporting segment 338. Moreover, in the functional position, a pair of feet 408, which also serve as handles, act to support frame 330 off of the room floor. Additionally, frame 330 is decoratively covered by a plurality of aesthetic covering panels 410; this can best be seen in FIG. 17.

Figure 23:
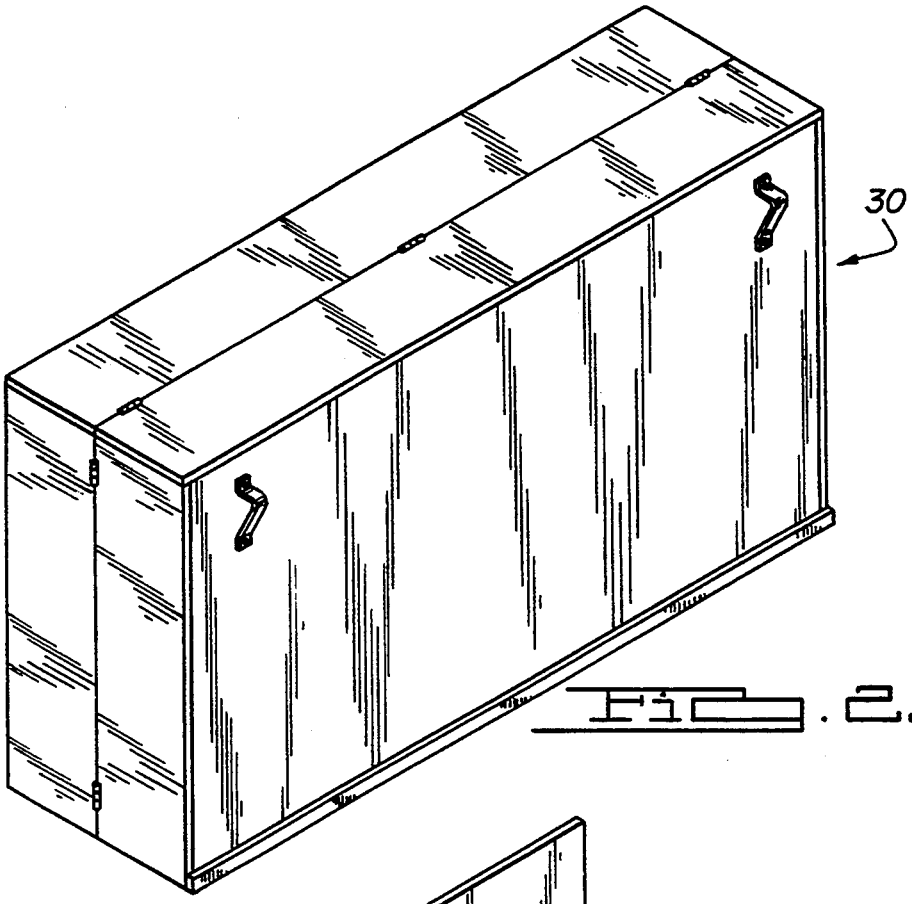
FIG. 23 is a perspective view of an alternate embodiment of the folding wall bed of the present invention of FIG. 17 shown in the substantially vertical stowed position.
Figure 24:
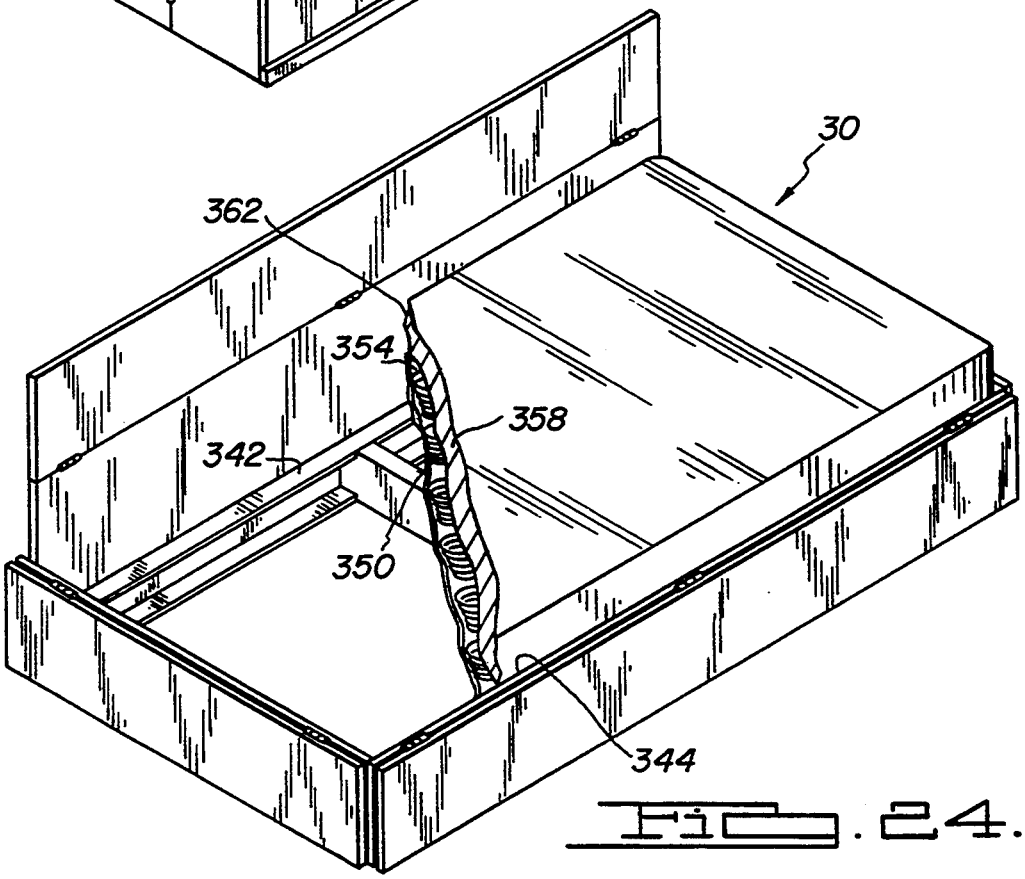
FIG. 24 is a perspective view with portions broken away therefrom of the alternate embodiment of the present invention folding wall bed of FIG. 24 shown in a substantially horizontal functional position.

An alternate embodiment of the second preferred construction is shown in FIGS. 23 and 24. This embodiment is designed similar to that of the preceding embodiment disclosed in FIGS. 17 through 22, however, the mattress 358 and box spring 350 are oriented such that sides 362 and 354 are coincidental with first edge 342 and second edge 344.

Figures 25, 26, 27:
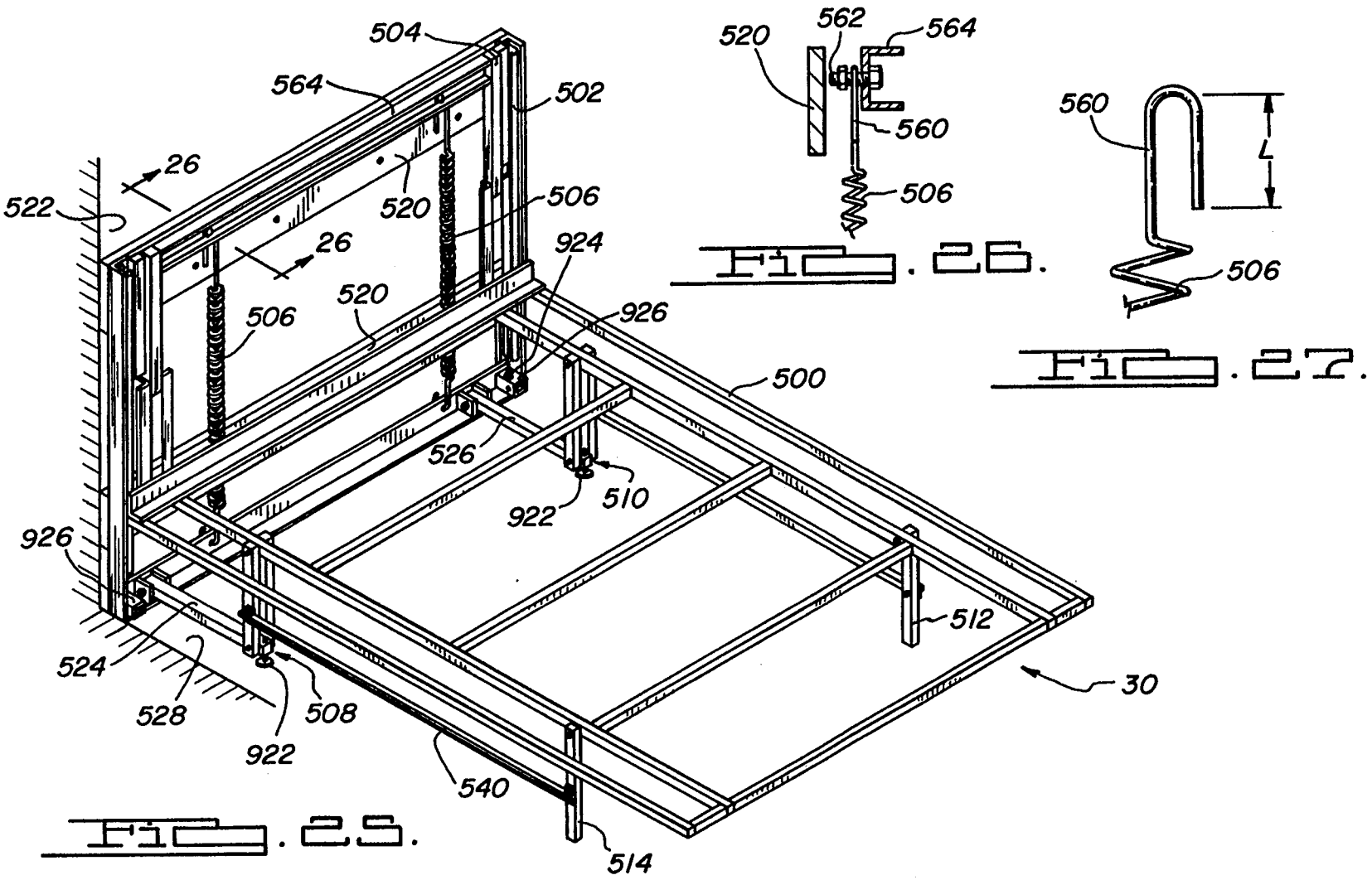
FIG. 25 is a perspective view of a third preferred embodiment of a wall mounted version of the folding wall bed of the present invention of FIG. 1, with the aesthetical cover panels and mattress removed, shown in a substantially horizontal functional position.
FIG. 26 is a sectional view, taken along line 26—26 of FIG. 25, showing a spring attachment employed in the third preferred embodiment of the present invention folding wall bed.
FIG. 27 is a fragmentary elevational view showing the spring employed in the third preferred embodiment of the present invention folding wall bed of FIG. 25.
Figure 30:
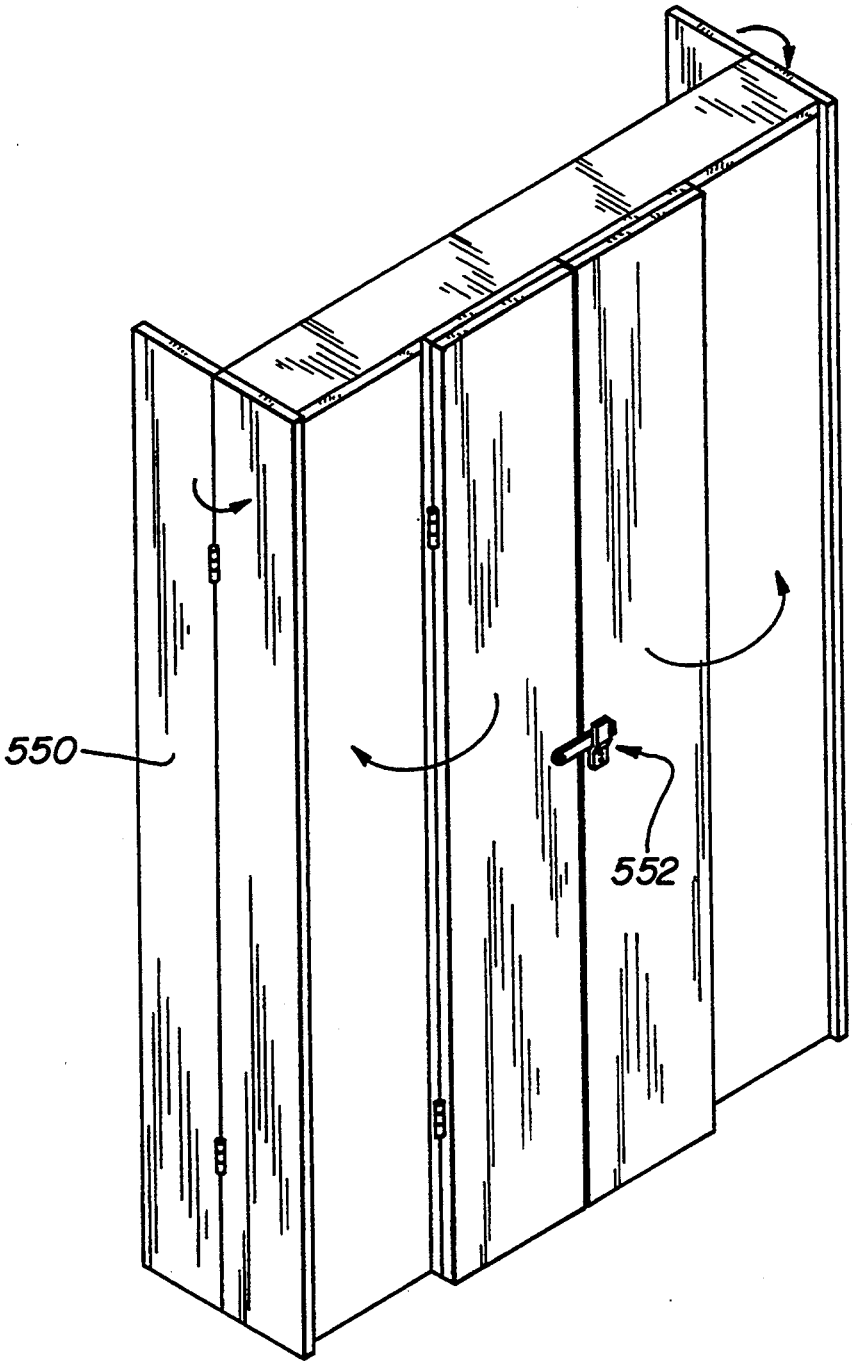
FIG. 30 is a perspective view of the third through fifth preferred embodiments including aesthetical covering panels shown in a substantially vertical stowed position.

A third preferred embodiment of a wall mounted version of folding wall bed 30 of the present invention is shown in FIG. 25. This folding wall bed 30 is comprised of an L-shaped frame 500, a stationary wall structure 502, a movable headboard structure 504, force generating device or springs 506 and a plurality of legs 508, 510, 512 and 514. A pair of boards 520 are affixed to wall structure 502 for attachment to an adjacent wall 522. Boards 520 also serve to keep the vertical members of wall structure 502 parallel. A pair of braces 524 and 526 project from wall structure 502. Adjustable screws 922 and feet provide lateral adjustment between braces 524 and 526, and floor 528. Each brace 524 and 526 is pivotably coupled to adjacent leg assemblies 508 and 510, respectively. Pairs of legs 508 and 510 are also pivotably coupled to frame 500. Furthermore, leg 514 is coupled for simultaneous retracting and extending movement with leg assembly 508 by a linkage mechanism 540. Leg 512 is similarly coupled to leg assembly 510. However, leg assembly 508 is not directly coupled to leg assembly 510 and leg 514 is not directly coupled to leg 512. Thus, a plurality of aesthetic covering panels 550 can be folded in accordance with the arrows showing in FIG. 30. A latch 552, mounted to the hidden surface (when stowed), may also be employed to retain various of aesthetic covering panels 550 in a folded position when the frame is pivoted to its functional position. Referring to FIGS. 26 and 27, each spring 506 has an upper loop 560 which is in slidable engagement with a bolt 562. Bolt 562 is affixed to a cross member 564 of headboard structure 504. Thus, frame 500 can be moved a distance referenced as L of approximately 2" before engagement of springs 506 when frame 500 is tipped downwardly from its substantially vertical stowed position. Of course, this type of spring 506 can be employed in any of the other embodiment beds disclosed herein. An adjustable stop 924 projects upward from a pair of outer open ended braces 926. Each stop 924 hits the L-shaped extension of the frame (similar to 182 of FIG. 4) when frame 500 is moved to its substantially vertical stowed position. Stops 924 are also employed to level the stowed frame 500 in a fore/aft direction.

Figure 28:
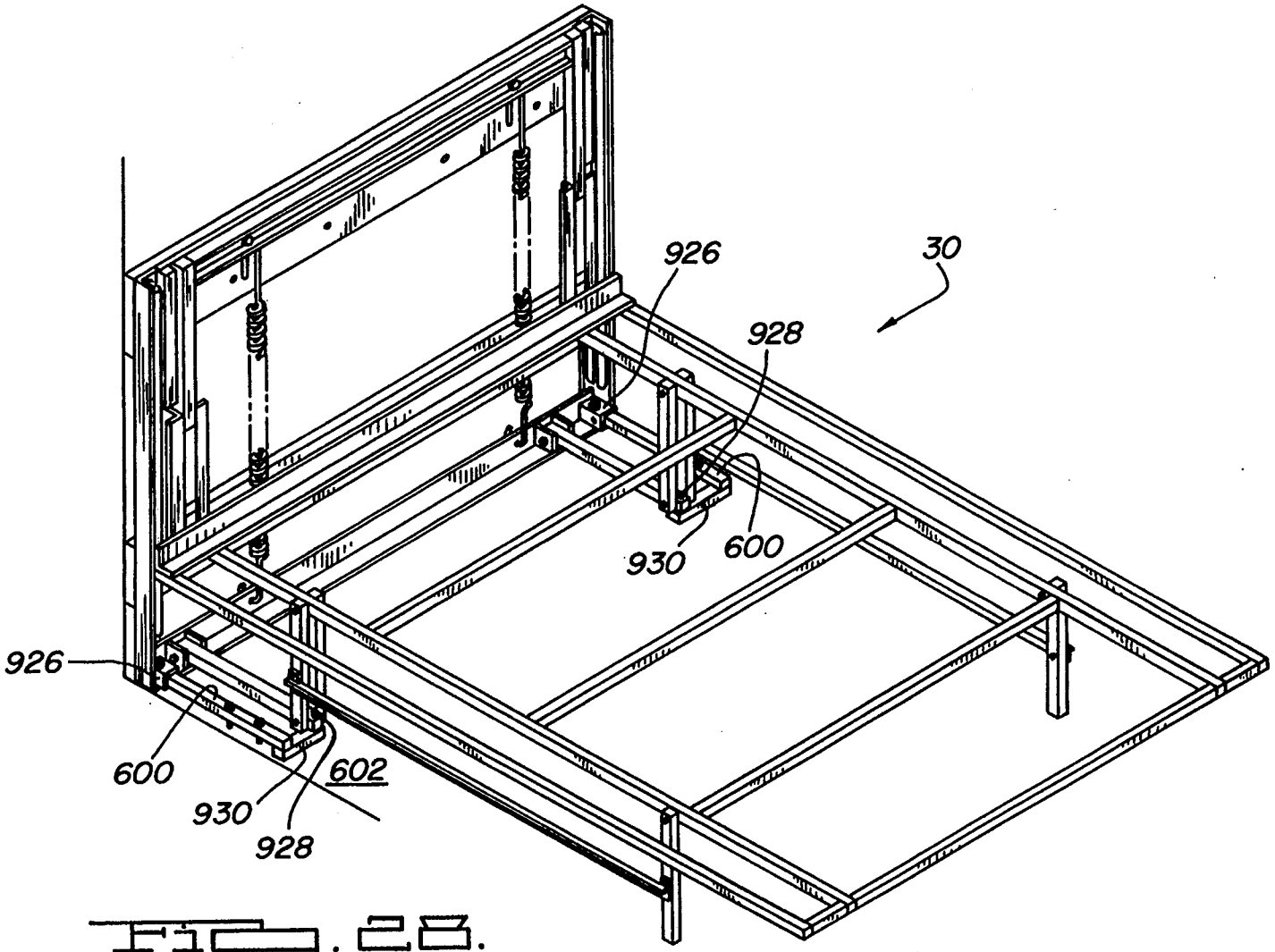
FIG. 28 is a perspective view of a fourth preferred embodiment of a floor mounted version of the folding wall bed of the present invention of FIG. 1, with the aesthetical cover panels and mattress removed, shown in a substantially horizontal functional position.

A fourth preferred embodiment of a floor mounted version of a folding wall bed 30 of the present invention is illustrated in FIG. 28. Bed 30 of this embodiment is substantially similar to that of the bed shown in FIG. 25, with an additional pair of floor mounting braces 600 being inserted into then bolted to outer open ended braces 926 and which are screwed to a floor 602. In this embodiment, the adjustment screw and foot of FIG. 25 is replaced with an adjustment bolt 928 between brace 524 and 526 (see FIG. 25) and a cross brace 930 proximate with floor 602. This adjustment bolt 928 provides lateral adjustment of the stowed frame.

Figure 29:
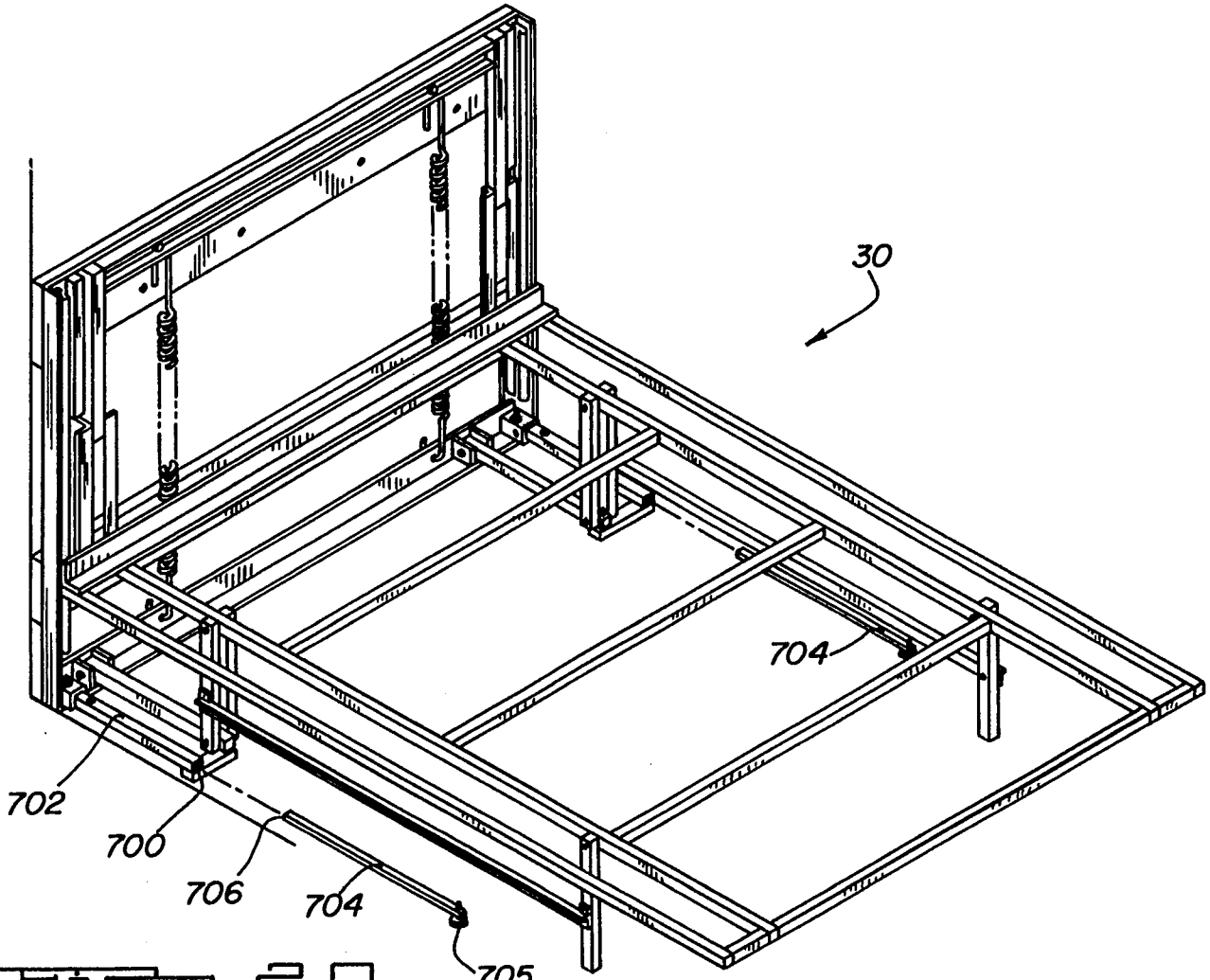
FIG. 29 is a perspective view of a fifth preferred embodiment of a freestanding version of the folding wall bed of the present invention of FIG. 1, with the aesthetical cover panels and mattress removed, shown in a substantially horizontal functional position.

A fifth preferred embodiment of a freestanding version of the folding wall bed 30 of the present invention is shown in FIG. 29. An end 706 of each of a pair of extension members 704 is insertable within an open distal end 700 of a corresponding outer brace 702. Extension members 704 serve to support bed 30 and to counteract the spring force during pivotal movement. Adjustable screw and foot levelers 705 are affixed to the opposite end of each extension member 704 to provide a tight fit against the floor. When the frame is stowed, extension members 704 are preferably removed and stored out of sight within the aesthetic covering panels. Of course, a variety of other adjustable or fixed stop members may be employed with any of the prior embodiments. It will be appreciated that the aesthetic covering panels 550 of FIG. 30 may be employed with any of the embodiments shown in FIGS. 25 through 29.

Figure 31:
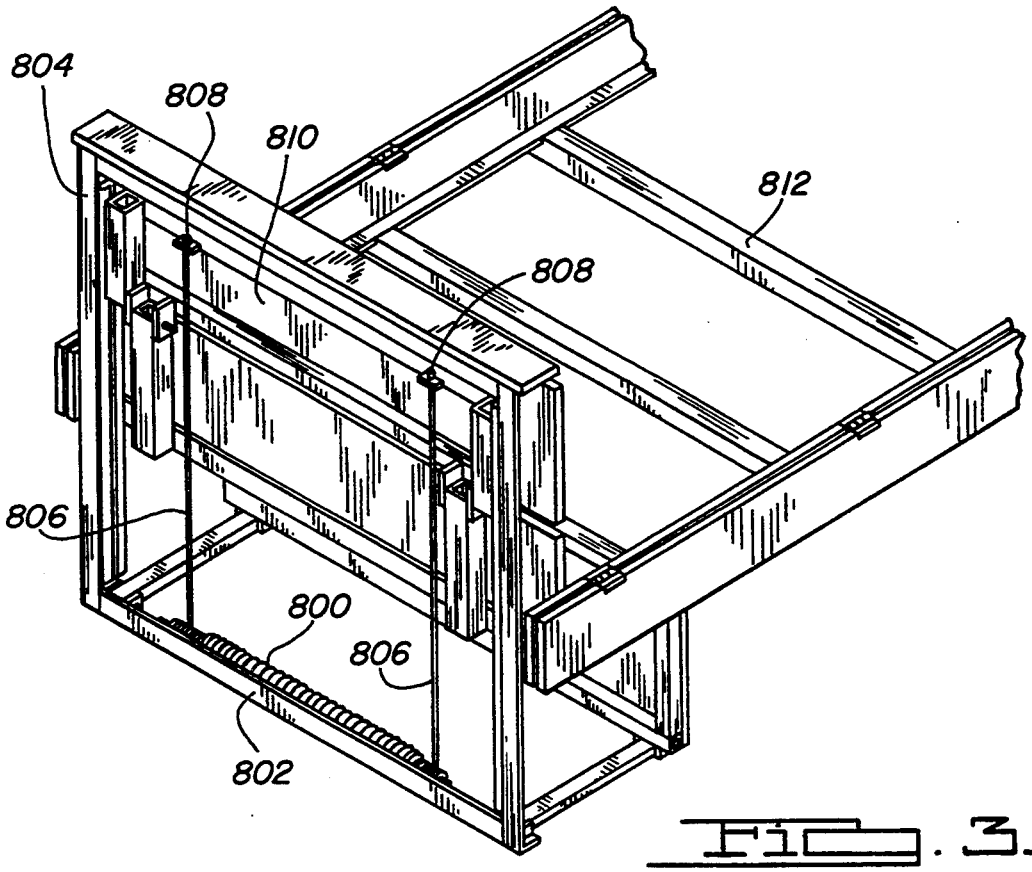
FIG. 31 is a fragmentary perspective view of another embodiment of a spring employed in combination with any of the aforementioned folding wall beds of the present invention of FIGS. 1—30.

Another embodiment of a force generating device or spring 800 is illustrated in FIG. 31. Spring 800 is a helically wound torsion spring mounted to a lower beam 802 of a wall structure 804. Each end of spring 800 is rotatably coupled to a cable 806 for pulling thereon. A distal end 808 of each cable is connected to a portion of a slidable headboard structure 810 for providing a biasing force to aid in pivoting a frame 812 between a stowed and a functional position (shown). This spring and cable system may be used for any of the previously discussed folding wall bed embodiments.

One skilled in the art would appreciate that the folding bed of the present invention is novel and nonobvious over prior constructions. For instance, the headboard structure of the present invention folding wall bed rises when the frame is moved from its substantially vertical stowed position to its substantially horizontal functional position. Also, pivoting of the frame about a movable first set of legs is advantageous over earlier folding beds since the present invention folding wall bed can be more compactly stowed against the adjacent wall. Furthermore, the bed height can be easily adjusted through adjustable leveling screws. The present invention folding wall bed is further advantageous in that it is self concealable within the folding aesthetic covering panels mounted to each side of the pivoting frame. Moreover, the specific spring and motor/screw force generating mechanisms are novel.

While many embodiments of the folding wall bed have been disclosed, it will be appreciated that various modifications may be made without departing from the present invention. For example, the engagement mechanism rollers may be replaced with a cable and sleeve or rod and sleeve combination. Also, the method of aesthetic covering the frame may be used in conjunction with a variety of other folding wall bed designs. Furthermore, a folding wall bed of similar construction to that of the present invention can be incorporated into a cabinet enclosure or wall recess. A torsion spring may be alternately mounted upon a headboard structure. Various materials have been disclosed in an exemplary fashion, however, a variety of other materials may of course be employed. It is intended by the following claims to cover these and any other departures from the disclosed embodiments which fall within the true spirit of this invention.

The invention claimed is:

1. A folding wall bed comprising:

a headboard structure;

a frame coupled to said headboard structure and operable for supporting a mattress thereon, said headboard structure rising in a substantially vertical direction when said frame is pivoted from a substantially vertical stowed position to a substantially horizontal functional position;

said mattress having a head, a foot and a pair of sides thereof;

said frame having a substantially L-shaped configuration with a mattress supporting segment having a first edge and a second edge thereof, said L-shaped configuration further having an extension segment projecting substantially perpendicular from said first edge of said mattress supporting segment, a first planar surface defined by said mattress supporting segment upholding said mattress thereon, a second planar surface defined by an opposite face of said mattress supporting segment and being substantially parallel to said first planar surface thereof while having at least one aesthetic covering panel attached thereto;

a first set of legs being pivotably attached to said frame and being juxtapositioned near said first edge of said mattress supporting segment thereof;

a second set of legs being pivotably attached to said frame and being juxtapositioned near said second edge of said mattress supporting segment thereof;

a wall structure being oriented in a substantially vertical direction and having at least one substantially vertical engagement mechanism associated therewith, said wall structure being proximate to said first edge of said mattress supporting segment of said frame;

said headboard structure being slidably associated with said engagement mechanism of said wall structure such that said headboard structure is slidable along a vertical plane defined by said wall structure, said extension segment of said frame is pivotably linked to said headboard structure, said headboard structure being slidably located in a raised position when said mattress supporting segment of said frame is pivoted to said substantially horizontal functional position and said headboard structure being slidably located in a retracted and relatively lower position when said mattress supporting segment of said frame is pivoted to said substantially vertical stowed position;

a force generating device aiding in the slidable movement of said headboard structure in relation to said wall structure, said force generating device having a first section engagably affixed to said headboard structure and having a second section engagably affixed to said wall structure; and a pair of braces each having a first end pivotably mounted to said wall structure and having a second end pivotably associated with said first set of legs.

2. The folding wall bed of claim 1 wherein:

said mattress supporting segment of said frame is defined by at least a pair of longitudinal rails and at least a pair of cross rails joined thereto;

said extension segment of said frame is defined by a pair of arms which project substantially perpendicular from said first edge of said mattress supporting segment; and said wall structure is defined by a pair of vertical beams joined by a substantially horizontal beam.

3. The folding wall bed of claim 2 further comprising:

a wedge-shaped bar being movably secured to said frame;

a spring biasing said wedge-shaped bar toward an extended position outward from said frame and toward said wall structure when said frame is in said substantially horizontal functional position;

an interlocking retraction device being proximate with said frame;

an interlocking receptacle being integrated within said wall structure; and said wedge-shaped bar engaging said interlocking receptacle of said wall structure upon pivoting said frame to said substantially horizontal functional position such that said frame is prevented from pivoting to said substantially vertical stowed position, when said interlock retraction device is actuated said wedge-shaped bar is retracted and disengaged from said interlocking receptacle of said wall structure such that said frame is pivotable to said substantially vertical stowed position.

4. The folding wall bed of claim 3 wherein:

said interlock retraction device is connected with said wedge-shaped bar by a cable.

5. The folding wall bed of claim 3 wherein:

said wedge-shaped bar is slidably biased in a direction substantially parallel with said pair of longitudinal rails of said frame and said spring is a compression spring.

6. The folding wall bed of claim 2 further comprising:

a pair of said aesthetic covering panels being pivotably hinged together along an adjacent longitudinal edge thereof, a first of said pair of covering panels being longitudinally affixed to one of said longitudinal rails of said frame, upon pivoting of said frame to a substantially vertical stowed position a second of said pair of covering panels is swung to an open position in planar alignment with said first covering panel attached to said frame whereby said wall structure is substantially hidden from view, and alternately, upon pivoting said frame to a substantially horizontal functional position said second covering panel is swung to a position overlapping said first covering panel.

7. The folding wall bed of claim 1 wherein:

said engagement mechanism further includes a pair of C-shaped channels having a vertical longitudinal orientation thereto and being attached to said wall structure.

8. The folding wall bed of claim 7 further comprising:

at least a pair of rollers projecting from said headboard structure and slidably engaging within an adjacent channel of said pair of C-shaped channels.

9. The folding wall bed of claim 1 further comprising:

a linkage mechanism being pivotally attached to said first set of legs and said second set of legs, said linkage mechanism urging said second set of legs into a functionally extended position which is substantially perpendicularly oriented below said mattress supporting segment of said frame when said frame is pivoted from said substantially vertical stowed position to said substantially horizontal functional position, said linkage mechanism pivotally urging said second set of legs into a stowed position which is substantially aligned with said second planar surface of said mattress supporting segment when said frame is pivoted from said substantially horizontal functional position to said substantially vertical stowed position.

10. The folding wall bed of claim 1 wherein:

said headboard structure is comprised of at least one said horizontal support which is joined by at least a pair of vertical supports thereto all of which are somewhat hidden by said aesthetic covering panel which is attached thereupon.

11. The folding wall bed of claim 1 wherein:

said first edge of said mattress supporting segment of said frame is juxtapositioned coincidental with said head of said mattress; and said second edge of said mattress supporting segment of said frame is juxtapositioned coincidental with said foot of said mattress.

12. The folding wall bed of claim 1 wherein:

said first edge of said mattress supporting segment of said frame is juxtapositioned coincidental with one of said pair of sides of said mattress.

13. The folding wall bed of claim 1 further comprising:

a force generating device includes at least one helically wound tension spring having a first end engagably affixed to said headboard structure and having a second end engagably affixed to a stationary member, said tension spring biasing said headboard structure.

14. The folding wall bed of claim 1 further comprising:

a force generating device includes a torsion spring biasing said headboard structure.

15. The folding wall bed of claim 1 further comprising:

a force generating device including:

an electric motor mounted upon a stationary member;

a threaded receptacle which is affixed to said headboard structure;

a worm gear with helically wound external threads therearound; and said electric motor rotates said worm gear such that said headboard structure and said threaded receptacle thereon are slidably raised and lowered.

16. The folding wall bed of claim 1 further comprising:

an aesthetic covering panel affixed to said headboard structure.

17. A folding wall bed which is pivotable from a substantially vertical stowed position to a substantially horizontal functional position, said folding bed comprising:

a frame having a substantially L-shaped configuration with a supporting segment having a first edge and a second edge thereof, said L-shaped configuration further having an extension segment projecting substantially perpendicular from said first edge of said supporting segment;

a wall structure having a substantially vertical component and a substantially horizontal component thereto, said substantially vertical component having at least one engagement mechanism thereupon;

the intersection of said supporting segment and said extension segment of said frame having at least one roller being rotatably attached externally thereto;

a headboard structure being slidably associated with said engagement mechanism such that said headboard structure is slidable along a vertical plane defined by said vertical component of said wall structure, said headboard structure being pivotably attached to said extension segment of said frame such that said headboard structure is slidably located in a raised position when said supporting segment of said frame is pivoted to said substantially horizontal functional position and said headboard structure is slidably located in a retracted and relatively lower position when said supporting segment of said frame is pivoted to said substantially vertical stowed position;

said roller of said frame being movable in a substantially horizontal direction when said supporting segment of said frame is pivoted from said substantially vertical stowed position to said substantially horizontal functional position and back again; and a force generating device aiding in the pivotable movement of said frame in relation to said wall structure, said force generating device having a first section engagably affixed to said frame and having a second section engagably affixed to said wall structure.

18. The folding wall bed of claim 17 wherein:

said substantially horizontal component of said wall structure being defined by at least one floor track and a stanchion extending substantially perpendicular from a leading edge thereof, said leading edge of said floor track being displaced opposite from said substantially vertical component; and said roller of said frame is longitudinally movable upon said floor track.

19. The folding wall bed of claim 18 wherein:

said supporting segment of said frame is defined by at least a pair of longitudinal rails and at least a pair of cross rails joined together.

20. The folding wall bed of claim 19 wherein:

said force generating device further comprises a torsion spring being attached to one of said cross rails of said supporting segment of said frame and having a cable attached to an opposite end thereof, said frame having a pulley rotatably affixed thereto around which said cable extends such that the longitudinal direction of said cable is reversed for attachment to said stanchion of said wall structure, said cable applies tension forces upon said tension spring when said supporting segment of said frame is pivoted from said substantially vertical stowed position to said substantially horizontal functional position.

21. The folding wall bed of claim 18 wherein:

one side of a box spring and one of said sides of said mattress are proximate with said first edge of said supporting segment of said frame.

22. The folding wall bed of claim 17 further comprising:

said engagement mechanism further includes a pair of C-shaped channels having a vertical longitudinal orientation attached to said vertical component of said wall structure; and at least a pair of rollers projecting from said headboard structure and slidably engaging within said pair of C-shaped channels.

23. The folding wall bed of claim 17 further comprising:

a box spring having a head, a foot and a pair of sides thereof, said box spring being juxtapositioned upon said supporting segment of said frame;

a mattress having a head, a foot and a pair of sides thereof, said mattress being juxtapositioned on top of said box spring with said head and said foot of each being coincidental with one another; and said heads of said box spring and said mattress being proximate with said first edge of said supporting segment of said frame.

24. The folding wall bed of claim 23 wherein:

a floor track of said wall structure is downwardly angled from an end proximate with said vertical component to a leading end oppositely projecting away therefrom.

25. A folding wall bed comprising:

a frame capable of supporting a mattress thereon;

a wall structure oriented in a substantially vertical direction, said frame pivotably coupled to said wall structure; and said frame movable from a substantially vertical stowed position to a substantially horizontal functional position;

a pair of braces extending from said wall structure substantially adjacent and parallel to a floor, said pair of braces suitable for interchangeably retaining a pair of removable extension members extending therefrom for providing support against said floor whereas said frame and said wall structure are freestanding without need for attachment to a surface selected from the group consisting of a wall and said floor, said pair of braces further suitable for interchangeably retaining at least a fastener for mounting to said floor.

26. A folding wall bed comprising:

a frame capable of supporting a mattress thereon;

a wall structure oriented in a substantially vertical direction, said frame movably coupled to said wall structure;

said frame movable from a substantially vertical stowed position to a substantially horizontal functional position;

an aesthetic covering panel attached to a side of said frame; and said aesthetic covering panel movable to expose a side portion of said mattress when said frame is in said substantially horizontal functional position and movable to cover said portion of said mattress when said frame is in said substantially vertical stowed position.

27. The folding wall bed of claim 26 wherein said aesthetic covering panel includes:

a first covering panel mounted to said side of said frame; and a second covering panel foldably coupled to said first covering panel for folding thereagainst when said frame is in said substantially horizontal functional position.

28. A folding wall bed comprising:

a headboard structure;

a frame coupled to said headboard structure and operable for supporting a mattress thereon, said headboard structure rising in a substantially vertical direction when said frame is moved from a substantially vertical stowed position to a substantially horizontal functional position; and a force generating device having a first end engagably coupled to said headboard structure and having a second end engagably affixed to a stationary member, said force generating device allowing a predetermined amount of free movement and not biasing said headboard structure until after said frame is moved a predetermined distance away from said substantially vertical stowed position.

29. A folding wall bed comprising:

a headboard structure;

a frame coupled to said headboard structure and operable for supporting a mattress thereon, said headboard structure rising in a substantially vertical direction when said frame is pivoted from a substantially vertical stowed position to a substantially horizontal functional position; and a force generating device including a torsion spring biasing said headboard structure.

* * * * *

UNITED STATES PATENT AND TRADEMARK OFFICE

CERTIFICATE OF CORRECTION

PATENT NO. : 5,446,932

DATED : September 5, 1995

INVENTOR(S) : Donald P. Voorhis

It is certified that error appears in the above-identified patent and that said Letters Patent is hereby corrected as shown below:

ON THE TITLE PAGE, under References Cited, insert the following header and information: --Other Publication-- --Brochure "Wall Bed Systems" by Wall Bed Systems, Inc. (prior to May 1993)--

Signed and Sealed this

Twenty-third Day of March, 1999

*Attest:*

Q. TODD DICKINSON

*Attesting Officer*

*Acting Commissioner of Patents and Trademarks*